US005259757A

United States Patent [19]

Plejdrup et al.

[11] Patent Number: 5,259,757

[45] Date of Patent: Nov. 9, 1993

[54] METHOD AND APPARATUS FOR SMOKELESS BURNOUT OF REGENERATIVE THERMAL OXIDIZER SYSTEMS

[75] Inventors: Marlin D. Plejdrup, Fullerton; Melanius D'Souza, Temple City, both of Calif.

[73] Assignee: Smith Engineering Company, Ontario, Calif.

[21] Appl. No.: 842,878

[22] Filed: Feb. 27, 1992

[51] Int. Cl.[5] ..... F27D 17/00

[52] U.S. Cl. ..... 432/181; 110/211; 422/175; 431/5

[58] Field of Search ..... 431/5; 432/180, 181, 432/182; 110/211, 212; 422/175, 182

[56] References Cited

U.S. PATENT DOCUMENTS 4,474,118 10/1984 Benedick ..... 110/211
5,098,286 3/1992 York ..... 432/181
5,149,259 9/1992 Greco ..... 110/212 X

*Primary Examiner*—Edward G. Favors

*Attorney, Agent, or Firm*—Christie, Parker & Hale

[57] ABSTRACT

Smokeless burnout of regenerative thermal oxidizer systems is accomplished by isolating the incineration system from the process flow and drawing fresh air into the heating regenerator at approximately one-fourth of the normal process flow. A purge/burnout fan is employed to induce flow through an idle regenerator drawing high temperature gas from the retention chamber through the idle regenerator. Gas is directed from the purge/burnout fan back into the retention chamber to oxidize contaminants which has been volatilized from the media in the third regenerator. The reduced flow rate of the system and maintaining flow through the regenerator being burned out while continuing to cycle the remaining regenerators as heating and cooling regenerators builds the temperature in the burnout regenerator until volatilization of all contaminants is achieved. Upon completion of burnout of the first burnout regenerator, that regenerator enters the cycle as a cooling regenerator and the next idle regenerator enters the burnout cycle.

7 Claims, 11 Drawing Sheets

OXIDIZER STACK
ATM
INDUCED DRAFT FAN
RETENTION CHAMBER 1450°F (MAXIMUM 1800°F)
CANISTER MEDIA BED
#1
#2
#3
#4
#5
BURNER #1
BURNER #2
BURNER #3
BURNER #4
RAW INJECTION NOZZLE
COMBUSTION AIR FAN
PURGE/ BURNOUT FAN
FRESH AIR
FRESH AIR INLET DAMPER
ISOLATION DAMPER
FRESH AIR

METHOD AND APPARATUS FOR SMOKELESS BURNOUT OF REGENERATIVE THERMAL OXIDIZER SYSTEMS

BACKGROUND OF THE INVENTION

1. Field of the Invention

The present invention relates generally to the removal of accumulated contaminant deposits on the heat transfer media of regenerative thermal oxidizers. More particularly, the present invention provides an apparatus and method for conducting a burnout of regenerator heat transfer media beds, while eliminating any discharge of visible unburned contaminants, which may be accomplished in an off-line condition for the oxidizer or a flow through on-line condition of the oxidizer. The present system is provided in combination with a purge system employed in normal operation of the oxidizer to preclude venting of unburned contaminants to the atmosphere during changeover between regenerators in a multiple regenerator system.

2. Description of the Prior Art

Regenerative incinerator systems use gas flow reversal to recapture heat, which would otherwise be lost to the atmosphere, during thermal oxidation of volatile contaminant compounds. A regenerative incinerator system consists of a gas heating regenerator which receives the processed gas from the system producing the volatile contaminants, a burner and retention chamber to oxidize the processed gas, and a regenerator which is heated by the exiting gas to cool the gas and reclaim the heat of the combustion process. After a period of time, flow of the gas through the system is reversed whereby the regenerator previously employed in heat recovery, now becomes the heating regenerator and the gas heating regenerator becomes the cooling regenerator through which gas passes prior to being released to the atmosphere thereby again raising the temperature of that regenerator bed.

Regenerator systems employing flow reversal in early systems allowed unburned gases in the inlet regenerator to be released to the atmosphere during the flow reversal. Use of multiple regenerator canisters with purge systems for removal of the unburned gas during flow reversals, eliminates this source of pollution. Certain prior art regenerative incinerator systems use positive pressure within the bottom of the idle regenerator to purge the unburned gases prior to flow reversal. Fresh air or incinerated air is introduced into the bottom of the idle regenerator which forces the residual gas through the media bed and into the combustion chamber. Use of positive pressure purging in this manner requires additional fan capability in the exhaust fan for the system and requires burning of recycled incinerated air thereby increasing fuel usage.

An improved system employing an induced draft purge is disclosed in U.S. Pat. No. 5,026,277 entitled REGENERATIVE THERMAL INCINERATOR APPARATUS, issued to James A. York on Jun. 25, 1991 which is assigned to the assignee of the present invention. The device disclosed in York uses negative pressure rather than positive pressure to purge the idle regenerator. The residual gas within the idle regenerator is removed by suction from the combustion air fan prior to flow reversal.

Operation of regenerative systems such as that disclosed in York and in U.S. Pat. Nos. 3,634,026 to Kuechler, issued Jan. 11, 1972, and U.S. Pat. No. 3,870,474 to Houston, require shutdown of the system to clean the regenerative beds of contaminant deposits which become entrapped in the heat transfer media. Removal of these contaminant deposits requires baking or burnout of the heat transfer media at temperatures sufficient to volitize the contaminant deposits on the heat transfer media. Previously, the volatilized contaminants were emitted to the atmosphere, thus causing a pollution problem. Typical prior art systems require removal of the heat transfer media from the beds in the regenerator canisters for burnout of the contaminant deposits. Alternative techniques such as that disclosed in Houston for removal of portions of the contaminated heat transfer media at the bottom of the regenerator with replacement of fresh heat transfer media at the top of the regenerator reduces the down time of the regenerator, and in some possible cases, could allow operation of the incinerator during media change out. The use of multiple canisters wherein one or more regenerators is idle during a process cycle, allows such operation.

The difficulty of performing such maintenance during operation of the system, including the potential hazards of an operating high temperature system, renders these methods less than ideal.

It is, therefore, desirable to provide a system for burnout of the regenerator media beds without removal of the media and while allowing minimal system down time, or continued operation of the system in incineration of the processed gas during burnout of one or more of the regenerators.

The present invention provides the capability to conduct a burnout of the trapped contaminant compounds in the media of the regenerators without removal of the media. The combination of the burnout feature of the present invention with an induced draft purging system avoids redundancy in system elements and provides maximum efficiency. The primary feature of this invention is that burnout of the regenerators is accomplished without the discharge of visible unburned contaminants to the atmosphere and may be accomplished while incineration of process gas is continued.

SUMMARY OF THE INVENTION

The present invention is incorporated in a multiple canister regenerative thermal incinerator. Each regenerator contains heat exchange media which preheats incoming gas or cools oxidized gas prior to exhausting gas to the atmosphere. A first inlet regenerator receives process gas which is warmed while passing through the regenerator and transmitted to a combustion retention chamber. The combustion retention chamber incorporates an air-fuel system having at least one burner for elevation of the chamber temperature to oxidize the process gas. A second regenerator receives gas from the retention chamber for exhaust through an induced draft fan to the atmosphere. Gas passing from the retention chamber heats the media of the second regenerator. A third regenerator is idle during this process flow and is simultaneously purged of partially treated gas remaining from a previous cycle. The purged gas is drawn by either a dedicated purge fan or a combination purge/-burnout fan from the third regenerator and directed to the process gas inlet of the system allowing processing and oxidation of the purged gas. The direction of flow of the gas through the system is periodically changed to enable heat recovered by cooling the process gas in the second regenerator to be used to heat incoming gas. The first regenerator becomes idle thereby allowing purging while the previously idle regenerator receives the gas from the retention chamber heating the regenerator and cooling the outlet gas.

Burnout of the system is accomplished in one mode by isolating the incineration system from the process flow and drawing fresh air into the heating regenerator at approximately one-fourth of the normal process flow as inlet gas into the system. The inlet gas is heated in the heating regenerator and cooled in the cooling regenerator and exhausted to the atmosphere. The purge/burnout fan is employed to induce flow through one of the idle regenerators drawing high temperature gas from the retention chamber through the idle regenerator. Gas is directed from the purge/burnout fan back to the retention chamber to oxidize contaminants which have been volatilized from the media in the third regenerator. The reduced flow rate of the system and maintaining flow through the regenerator being burned out, while continuing to cycle the remaining regenerators as heating and cooling regenerators, builds the temperature in the burnout regenerator until volatilization of the contaminants is achieved. Upon completion of burnout for the first burnout regenerator, that regenerator enters the cycle as a cooling regenerator and the next idle regenerator enters the burnout cycle.

Burnout of each regenerator is thereby accomplished to volatilize the contaminant compounds deposited in the heat transfer media beds. Direction of the volatilized contaminants through the retention chamber assures their incineration precluding soot or smoke in the gas exhausted from the system.

In the alternative, burnout of the system may be conducted by reducing the process gas flow to approximately one quarter of the normal flow for an "on the fly" burnout. Cycling of the regenerators into the burnout phase replaces purging of the regenerator brought to the idle condition for burnout.

FIGS. *3a–c* are schematic flow diagrams showing the various cycles of operation of the preferred embodiment of the invention for normal process gas flow with purging.

FIGS. *4a–c* are schematic flow diagrams showing the various cycles of operation of the preferred embodiment of the invention during burnout operations.

FIGS. *5a–c* are schematic flow diagrams showing the various cycles of operation of the preferred embodiment of the invention during "on the fly" burnout.

The advantages of the present invention may be best understood with reference to the drawings and the following detailed description of the invention.

DETAILED DESCRIPTION

Figure 1:
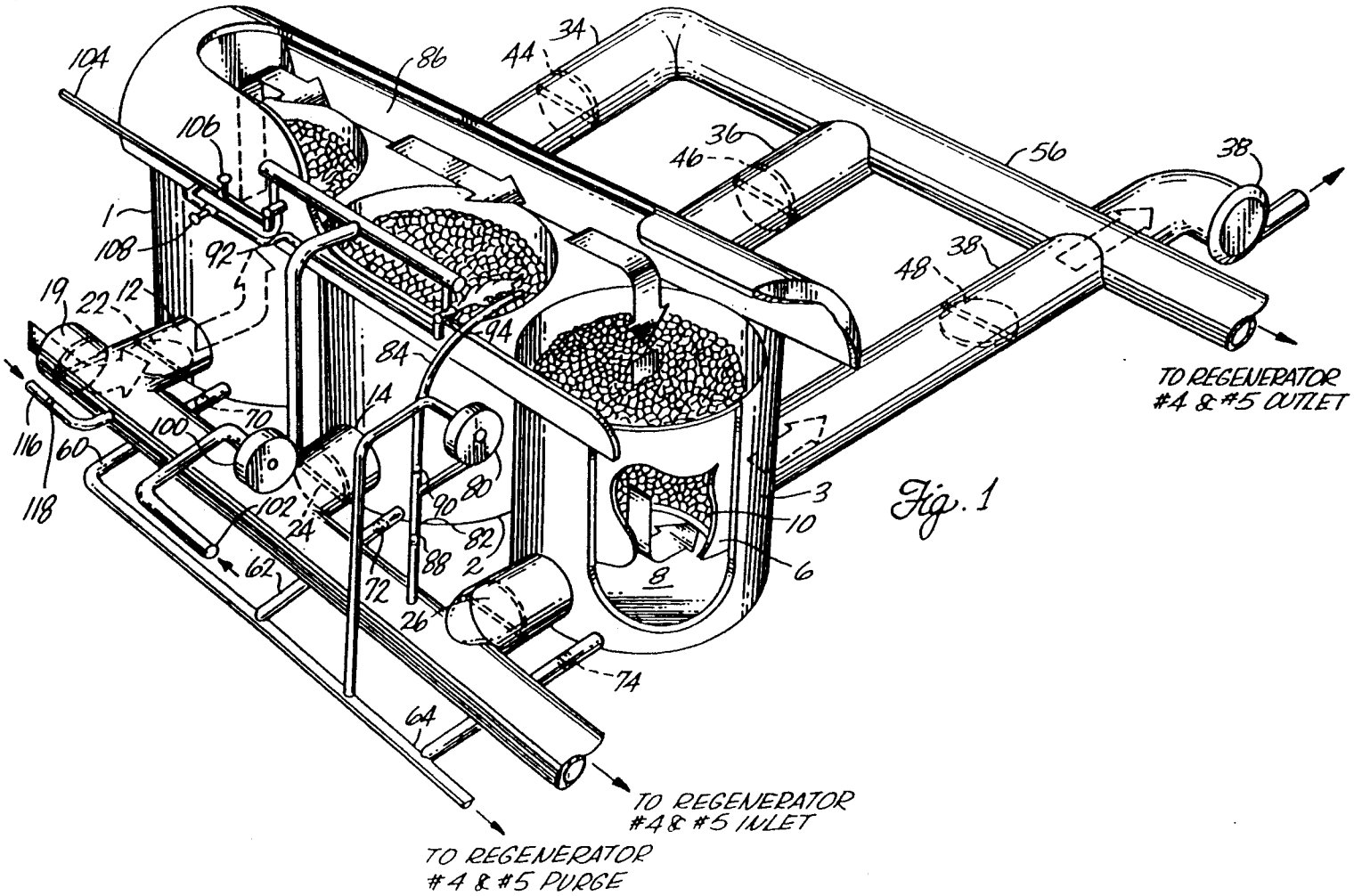
FIG. 1 is an isometric view of a preferred embodiment of the invention showing three regenerator canisters of a multiple canister system.

The embodiment shown in FIG. 1 demonstrates the basic elements of the present invention. The invention is employed in a thermal incinerator system having multiple regeneration canisters. The embodiment described herein and disclosed in FIGS. 2–5 incorporates five regenerators. FIG. 1 shows three of the five regenerators for simplicity. The present invention is operable with three or more regenerators.

FIG. 1 displays three regenerators 1, 2, and 3 each consisting of a gas permeable support structure 6 above a closed plenum 8. Heat transfer media 10 such as ceramic, porcelain, quartz gravel, or metal is contained within the support structure.

Connected to the base of regenerators 1, 2, and 3 are inlet conduits 12, 14, and 16 respectively, which communicate with the plenum in the base of each regenerator. Damper valves 22, 24, and 26 in each of inlet conduits respectively, may be positioned open or closed for selectively connecting the regenerators with an intake conduit 32 connected to the inlet conduits.

Also connected to the base of regenerators 1, 2, and 3, are outlet conduits 34, 36, and 38 respectively, which also communicate with the plenum. Damper valves 44, 46, and 48 are contained in the outlet conduits which may be positioned open or closed for selectively communicating the regenerators with an exhaust conduit 56. An induced draft exhaust fan 58 is connected to the exhaust conduit for venting of the processed effluent to the atmosphere.

Additionally, connected to the base of regenerators 1, 2, and 3 are purging conduits 60, 62, and 64 respectively, which also communicate with the plenum. Damper valves 70, 72, and 74 may be opened or closed for connecting the plenum of the respective regenerator through the associated purging conduit and through purge/burnout fan 80 into a common conduit with a first branch 82 connected to the intake conduit. The exhaust from fan 80 is also connected through a common conduit 84 to a retention combustion chamber 86, which extends over and interconnects the top of the regenerators. Damper valves 88 and 90 control flow of the gas from the purge/burnout fan through conduits 82 and 84, respectively.

The combustion chamber is heated by burners 92 and 94, which receive combustion air from fan 100 through conduit 102. Conduit 104 delivers fuel to the burners through valves 106 and 108, respectively.

Control of the process gas for burnout of the system is accomplished through isolation damper valve 110 in the intake conduit. A fresh air conduit 112 connected to the intake conduit downstream of isolation valve 110 allows the intake of fresh air through inlet damper valve 114.

Figure 2:
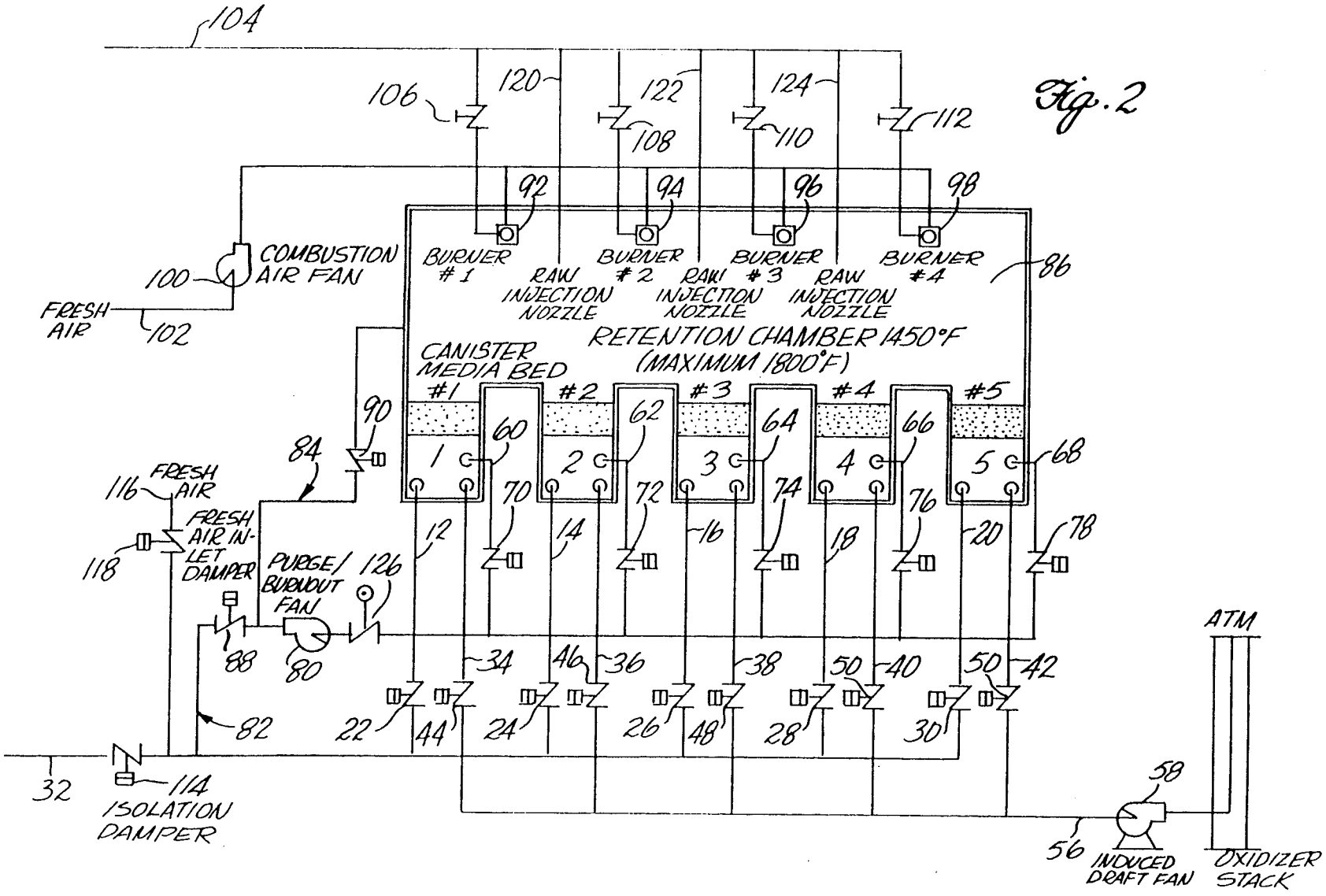
FIG. 2 is a schematic diagram of the preferred embodiment of the system shown in FIG. 1 for a five canister system.

FIG. 2 illustrates the present invention for a five regenerator system. Regenerators 4 and 5, not shown in FIG. 1, are shown schematically in FIG. 2 with associated intake conduits 18 and 20, intake damper valves 28 and 30, outlet conduits 40 and 42, outlet damper valves 50 and 52, purged conduits 66 and 68, and purged damper valves 76 and 78, all components operating as previously described for comparable elements associated with regenerators 1–3. Additional burners 96 and 98 with associated gas control valves 110 and 112 are shown in the combustion retention chamber 86 with raw gas injection nozzles 120, 122, and 124, not shown for simplicity in FIG. 1, which provide for additional temperature control and uniformity in the retention chamber.

Operation of the present invention in the normal gas processing mode is exemplified in Table I and FIG. *3a–c*. As shown in the Table, two regenerators operate in the inlet mode and two regenerators operate outlet mode while the fifth regenerator is purged.

TABLE I

| REGENERATOR | 1 | 2 | 3 | 4 | 5 |
|---|---|---|---|---|---|
| Normal | I | I | O | O | P |
| Cycling; | P | I | I | O | O |
| | O | P | I | I | O |
| | O | O | P | I | I |
| | I | O | O | P | I |

I = INLET
O = OUTLET
P = PURGE

Figure 3A:
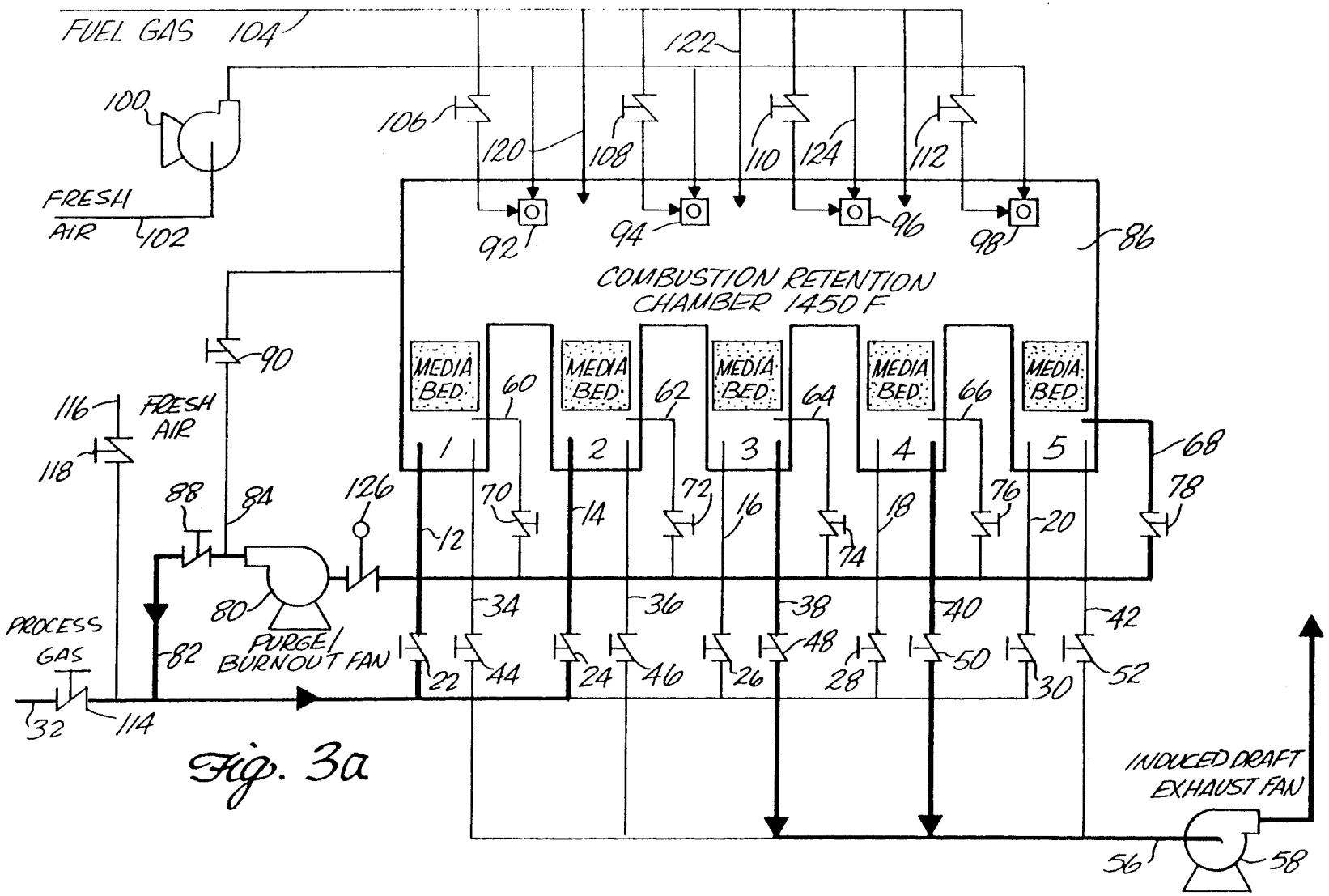
Figure 36:
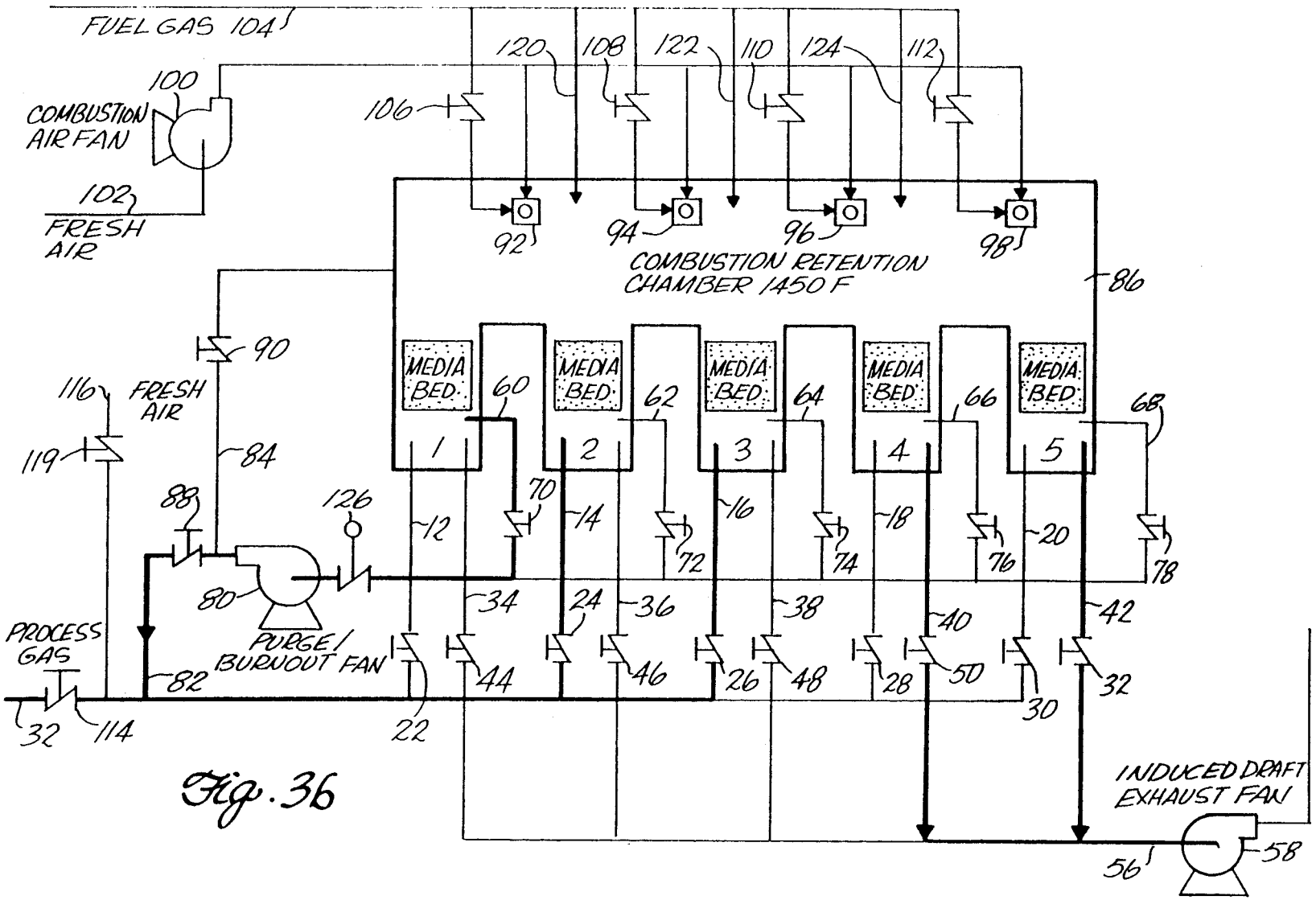

Referring to FIG. 3*a*, and the first line of Table I, regenerators 1 and 2 begin operation in the inlet mode. Valves 22 and 24 are open allowing process gas flowing through the intake conduit through inlet conduits 12 and 14 into the regenerators. Process gas flows through the regenerator media beds into retention chamber 86. In operation, the media beds of regenerators 1 and 2 have been warmed in a previous cycle, and now warm the process gas flowing through them to the retention chamber. The burners in the retention chamber maintain the retention chamber at an oxidation temperature of approximately 1450° F., which oxidizes the contaminant compounds present in the process gas. Regenerators 3 and 4 are the outlet regenerators with valves 48 and 50 in the open condition allowing the oxidized gas from the retention chamber to be drawn through the media beds in regenerators 3 and 4 through outlet conduits 38 and 40 into exhaust conduit 56. Reduced pressure in exhaust conduit 56 is provided by an induced draft fan 58, which exhausts the gas to atmosphere through an oxidizer stack. Gas flowing from the retention chamber through the media beds of regenerators 3 and 4 heats the heat transfer materials in those beds.

Regenerator 5 undergoes purging by opening of damper valve 78, which allows purge/burnout fan 80 to draw any gas remaining in the media bed of regenerator 5 through purge conduit 68. The purged gas flows from the purge/burnout fan through damper valve 80 and through conduit 82 into the intake conduit where it joins the process gas for incineration in the system.

As shown in FIG. 3*b* for the next cycle of the system, regenerator 3 transitions from an outlet regenerator to an inlet regenerator by closing of valve 48 and opening of valve 26. Heat transferred to the media bed of regenerator 3, during the prior cycle, is then employed to heat the inlet process gas flowing into the retention chamber.

Regenerator 5, which was undergoing purging in the previous cycle, becomes an outlet regenerator by closing valve 78 and opening of valve 52 thereby allowing incinerator gas from the retention chamber to flow through the media bed to heat the heat transfer material therein. Regenerator number 1 previously transferring heat to the incoming process gas is now purged by the closing inlet valve 22 and opening outlet valve 70 thereby drawing any process gas remaining in regenerator number through the purge/burnout fan and into the intake conduit.

Figure 3C:
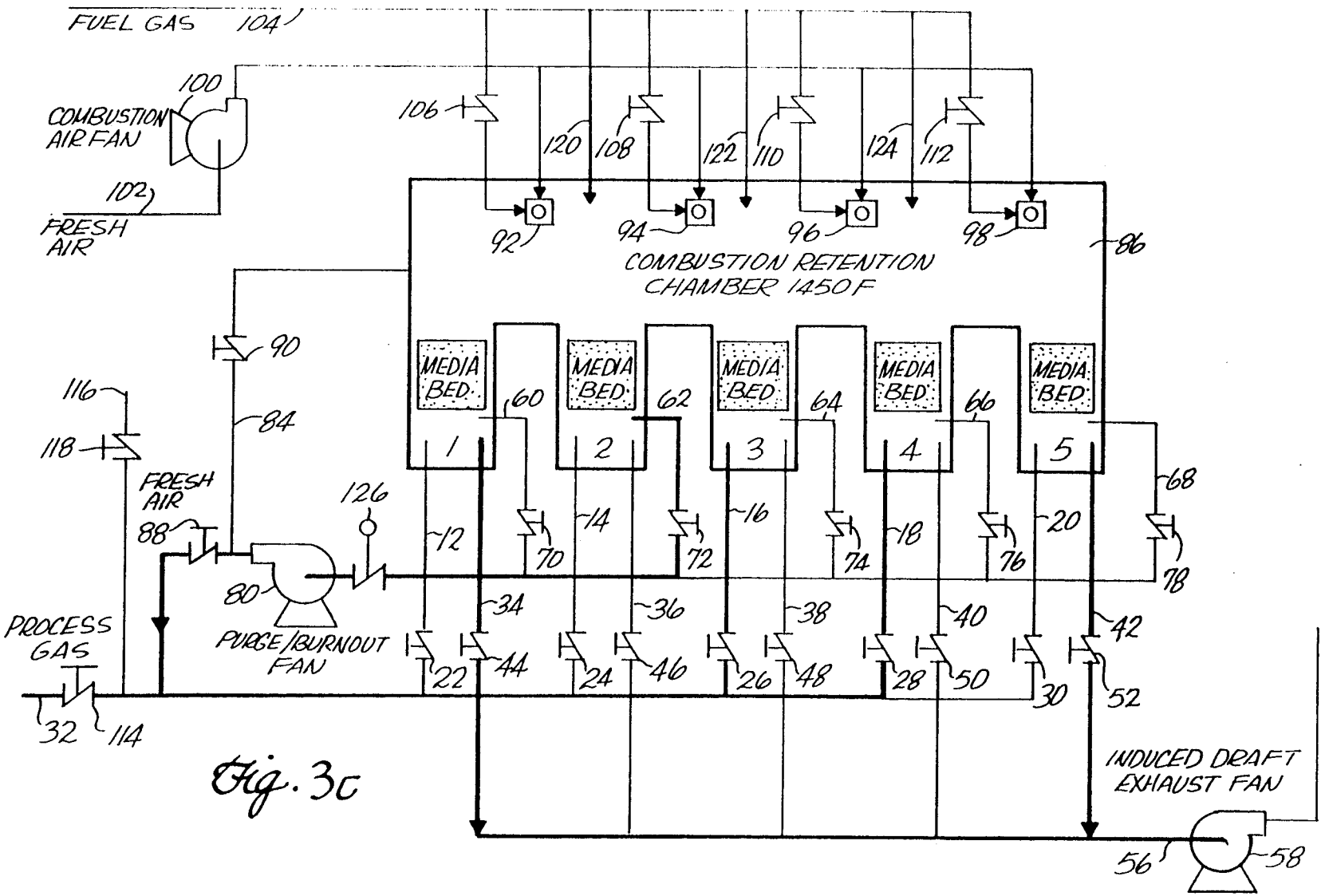

The next cycle change illustrated by the third line of Table I and FIG. 3*c* results in a transition of regenerator 4 from an outlet to inlet regenerator by the closing of valve 50 and opening of valve 28, and transitioning of regenerator 1 from its purge cycle to an outlet cycle by closing of valve 70 and opening of valve 44.

Regenerator 2 becomes the idle regenerator which is purged by closing valve 24 and opening valve 72 allowing any unoxidized process gas to be drawn out of regenerator 2 through the purge/burnout/fan and into the intake conduit.

Cycling of the thermal incinerator continues through the conditions shown in Table I with normal cycling at a period of approximately 45 to 65 seconds. Operation of the system with three regenerators is accomplished by eliminating duplicated inlet and outlet regenerators while operation of systems with greater numbers of regenerators can be accomplished adding paired inlet, outlet, and idle/purge regenerators as required for system flow rate and cycle timing.

Figure 4A:
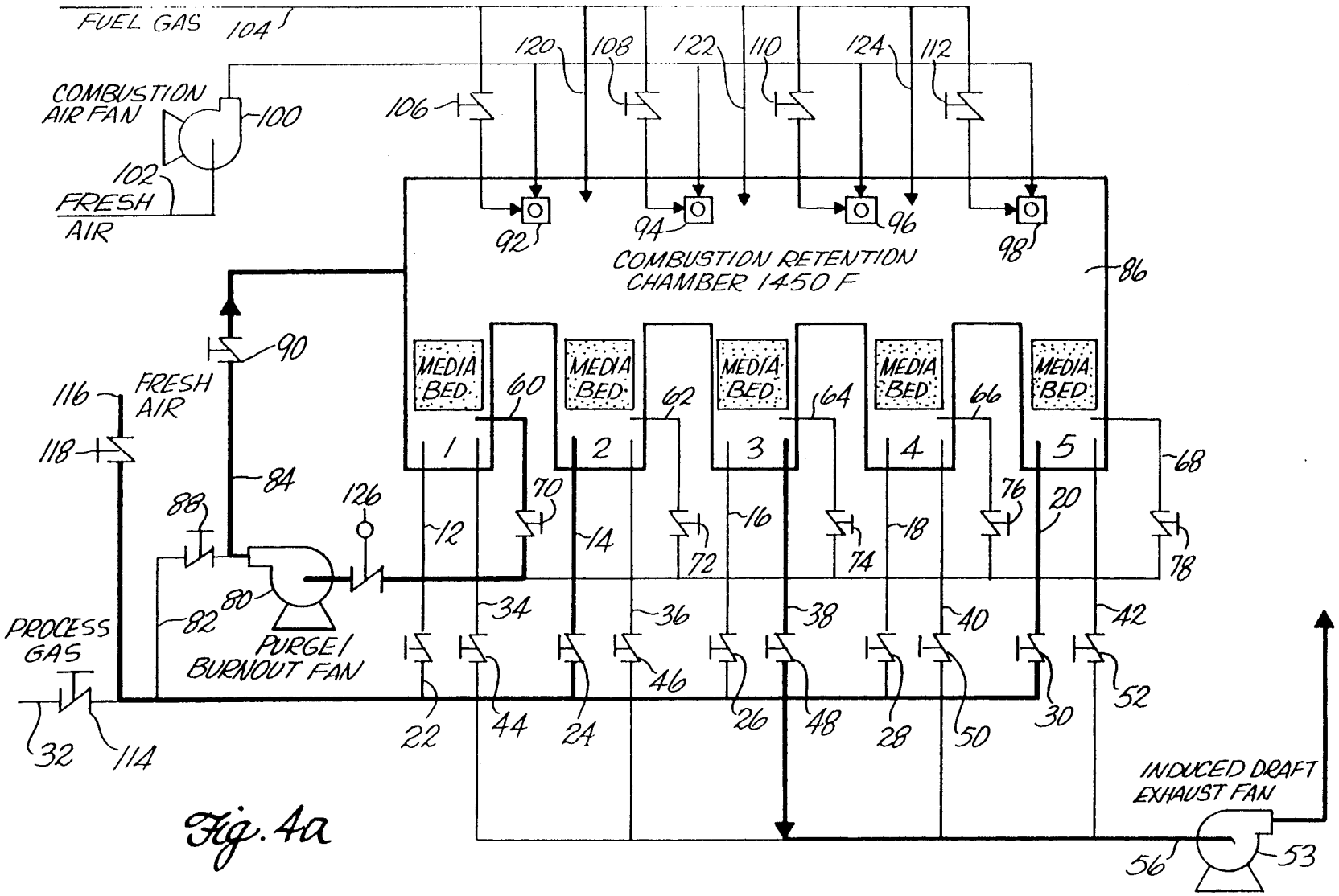
Figure 4B:
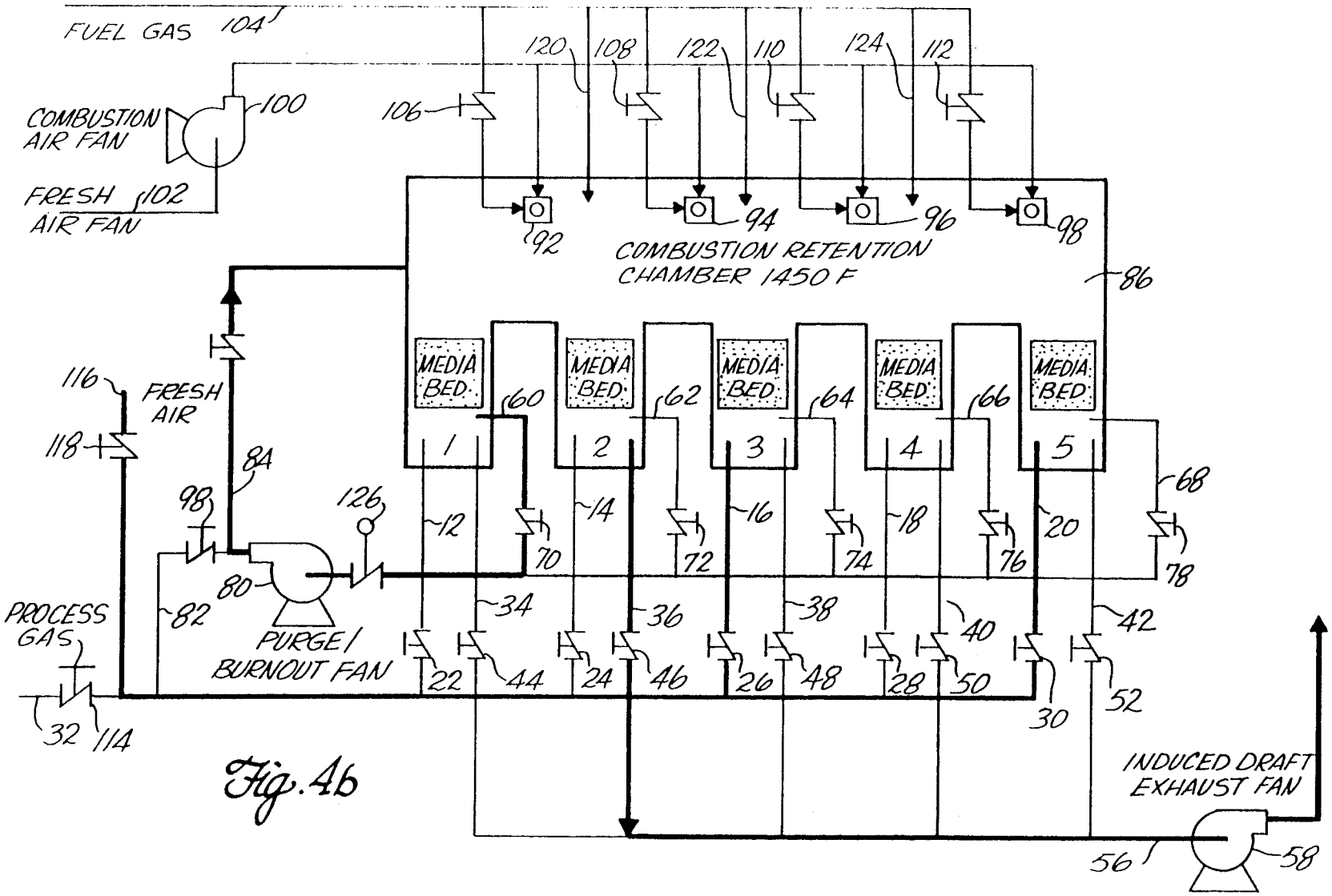
Figure 4C:
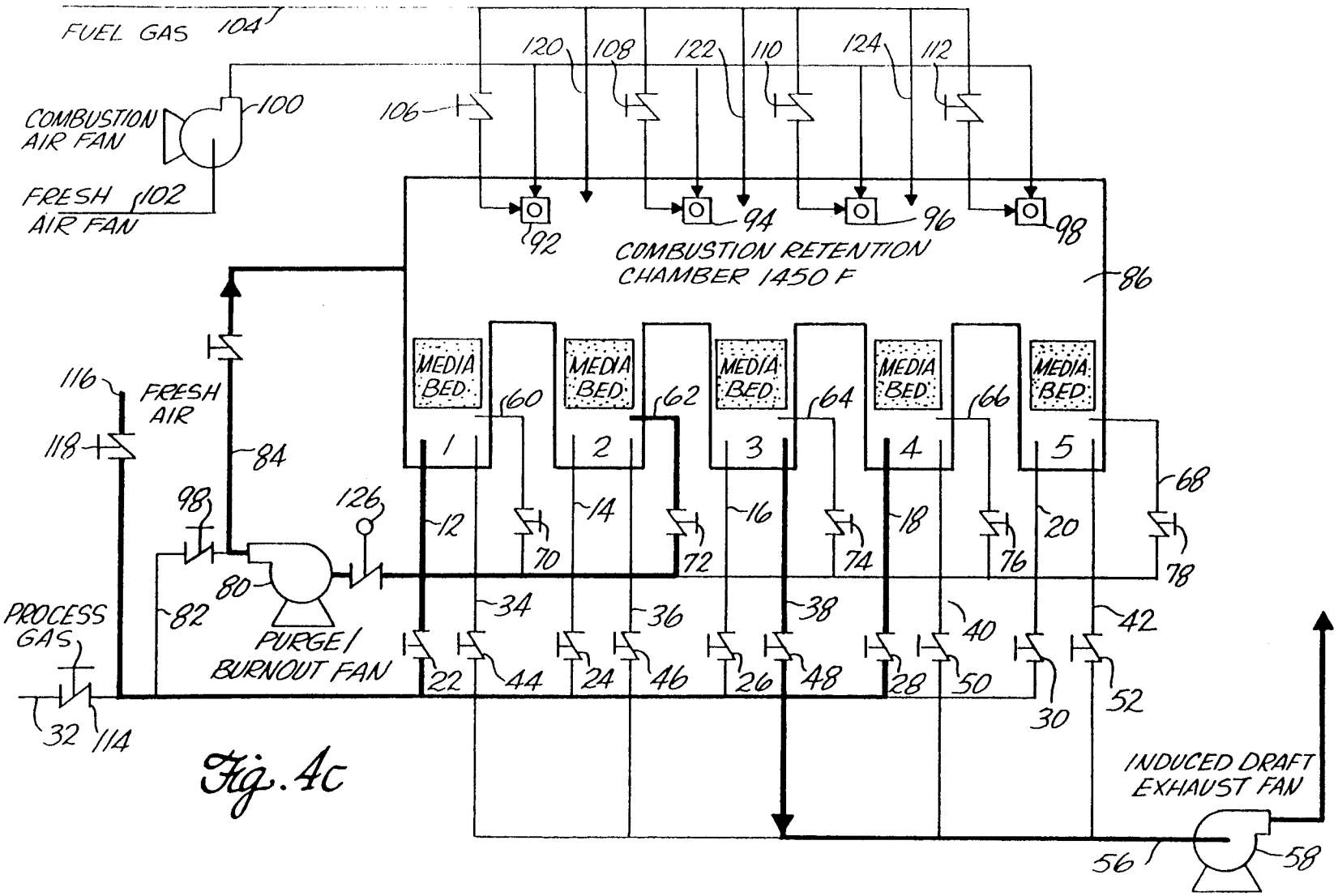

Operation of the present invention in a first burnout mode is demonstrated in Table II and FIGS. 4*a–c*. To accomplish a burnout in this mode, the regenerative thermal oxidizer is removed from the incineration mode and isolated from the process flow by closing isolation damper 114. Fresh air inlet damper 118 is opened allowing air to be drawn through conduit 116 into the intake conduit. As shown in Table II, burnout is initiated on regenerator 1 at the completion of a normal incineration cycle in which regenerator number 1 has completed a cycle as the outlet regenerator. Consequently, regenerator number 1 already holds an elevated temperature in the media bed. In the sequence shown in Table II for the first line of the burnout mode and FIG. 4*a*, inlet valve 22 and outlet valve 44 for regenerator number 1 are placed in the closed condition and purge valve 70 is opened allowing gas to be drawn through the purge/burnout fan from the regenerator. Isolation damper 88 is closed, while isolation damper 90 is opened allowing gas to flow from the purge/burnout fan through conduit 84 into the combustion retention chamber. Regenerator 5 is operating as an inlet regenerator throughout the burnout of Regenerator 1 to cool down with valve 30 open and valves 52 and 78 closed. Regenerator 2 is also operating as the inlet regenerator with valve 24 open, and valves 46 and 72 closed. Air flowing through conduit 116 and the intake conduit to inlet conduit 14 is heated in regenerator 2 flowing through the combustion retention chamber to regenerator number 3, which is acting as the outlet regenerator having valves 26 and 74 closed with valve 48 open to discharge the air through the exhaust conduit 56 and induced draft fan 58. Regenerators 4 is idle with all valves closed throughout the burnout of regenerator 1. The regenerators will continue to cycle as shown in Table II until the temperature in the plenum below the media bed of regenerator 1 reaches burnout temperature and the contaminants trapped in the media bed have been volatilized.

TABLE II

| REGENERATOR | 1 | 2 | 3 | 4 | 5 | |
|---|---|---|---|---|---|---|
| Normal | P | O | O | I | I | Normal |
| Cycling | O | O | I | I | P | Incineration |
| | | | | | | Mode |
| Start #1 | B | I | O | C | I | This is |
| Regenerator | B | O | I | C | I | repeated |
| Inlet | B | I | O | C | I | until the |
| Flow | B | O | I | C | I | area below the |
| (Maximum of | B | I | O | C | I | bed reaches |
| 50% capacity) | . | . | . | . | . | burnout temp. |
| | . | . | . | . | . | |
| | . | . | . | . | . | |
| | B | O | I | C | I | |
| Start #2 | I | B | O | I | C | |
| Regenerator | I | B | I | O | C | |
| | I | B | O | I | C | |
| | I | B | I | O | C | |
| | . | . | . | . | . | |
| | . | . | . | . | . | |
| | . | . | . | . | . | |

TABLE II-continued

| REGENERATOR | 1 | 2 | 3 | 4 | 5 | |
|---|---|---|---|---|---|---|
| Regenerator #2 at burnout temp. | I | B | O | I | C | |
| Start #3 Regenerator Burnout | C | I | B | O | I | |
| | C | I | B | I | O | |
| | C | I | B | O | I | |
| | C | I | B | I | O | |
| | . | . | . | . | . | |
| | . | . | . | . | . | |
| | . | . | . | . | . | |
| Regenerator #3 at burnout temp. | C | I | B | O | I | |
| Start #4 Regenerator Burnout | I | C | I | B | O | |
| | O | C | I | B | I | |
| | I | C | I | B | O | |
| | O | C | I | B | I | |
| | . | . | . | . | . | |
| | . | . | . | . | . | |
| | . | . | . | . | . | |
| Regenerator #4 at burnout temp. | I | C | I | B | O | |
| Start #5 Regenerator Burnout | O | I | C | I | B | |
| | I | O | C | I | B | |
| | O | I | C | I | B | |
| | I | O | C | I | B | |
| | . | . | . | . | . | |
| | . | . | . | . | . | |
| | . | . | . | . | . | |
| Regenerator #5 at burnout temp. | O | C | C | I | B | |
| Normal Cycling | P | O | O | I | I | Return to Normal Incineration Mode. |
| | O | O | I | I | P | |

I = INLET
O = OUTLET
P = PURGE
B = BURNOUT
C = CLOSED/IDLE

The next cycle of the burnout of regenerator number 1 is shown in the next line of Table II and FIG. 4*b*, wherein regenerator number 4 remains idled by closing all valves and regenerator number 3 becomes the inlet regenerator by opening valve 26 and closing valve 48. Regenerator number 2 operates as the outlet regenerator by opening valve 46 and closing valve 24. Regenerator number 5 remains an inlet regenerator throughout the burnout cycle for regenerator 1.

Cycling of regenerators 2 and 3 continues in the sequence, as shown in Table II, while gas flow from the retention chamber drawn by the purge/burnout fan through purge valve 70 of regenerator number 1 continues to increase the temperature of the media bed. When temperature in the plenum below the media bed of regenerator number 1 reaches burnout temperature, burnout is complete and the contaminant compounds trapped in the heat transfer media have been volitized and drawn through the purge/burnout fan to the combustion retention chamber for oxidation.

Upon completion of the burnout of regenerator number 1, regenerator 2 is placed in the burnout configuration with the closing of valves 24 and 46 and opening of valve 72 to allow drawing of gas from regenerator 2 through the purged burnout fan. It should be noted that the cycle immediately prior to the burnout configuration of regenerator 2 included regenerator 2 operating as the outlet regenerator. Regenerator 1 operates as an inlet continuously for cool down and regenerators 3 and 4 cycle as inlet and outlet regenerators for the system as shown in Table II. The first cycle of the regenerator 2 burnout is shown in FIG. 4*c*. Regenerator 1 is an inlet regenerator with valve 22 in the open position and valves 44 and 70 in the closed position. Regenerator 3 is the outlet regenerator with valves 26 and 74 in the closed position, and valve 48 in the open position. Regenerator is also an inlet with valves 50 and 72 closed and valve 28 open. Regenerator 5 is idle throughout the burnout cycle with all valves closed.

During the next cycle, as shown in Table II, regenerator 1 remains an inlet for cooling. Regenerator 3 becomes the inlet regenerator with valve 26 open and valves 48 and 74 closed, while regenerator 4 becomes the outlet regenerator with valve 50 open and valves 28 and 76 closed. Regenerator 5 remains idle with all valves closed.

Cycling of regenerators 3 and 4 continues until temperature in the plenum of regenerator 2 reaches burnout temperature as previously described with regenerator 1. Burnout of regenerators 3, 4, and 5 is then accomplished sequentially as described for regenerators 1 and 2 and as shown in Table II.

A damper 120 controls the inlet to the purge/burnout fan for adjustment of purge and burnout flows from the regenerators. The purge/burnout fan is sized to handle the flow volume required during normal purging of the media beds in a regenerator when the oxidizer is in the normal incineration mode. In the embodiment shown the purge cycle in the incineration mode lasts approximately 45 to 65 seconds for each regenerator, while in the burnout mode, the purge/burnout fan continues to exhaust the same regenerator for approximately 1 hour to reach the desired burnout temperature.

The burnout cycles described in Table II are used in an alternate mode for continuing flow of process gas at a reduced flow rate. Valve 114 is throttled but remains open and valve 118 remains closed. Cooling rate is approximately 50% of that in the next mode to be described, however, it remains much faster than the burnout rate.

Figure 5A:
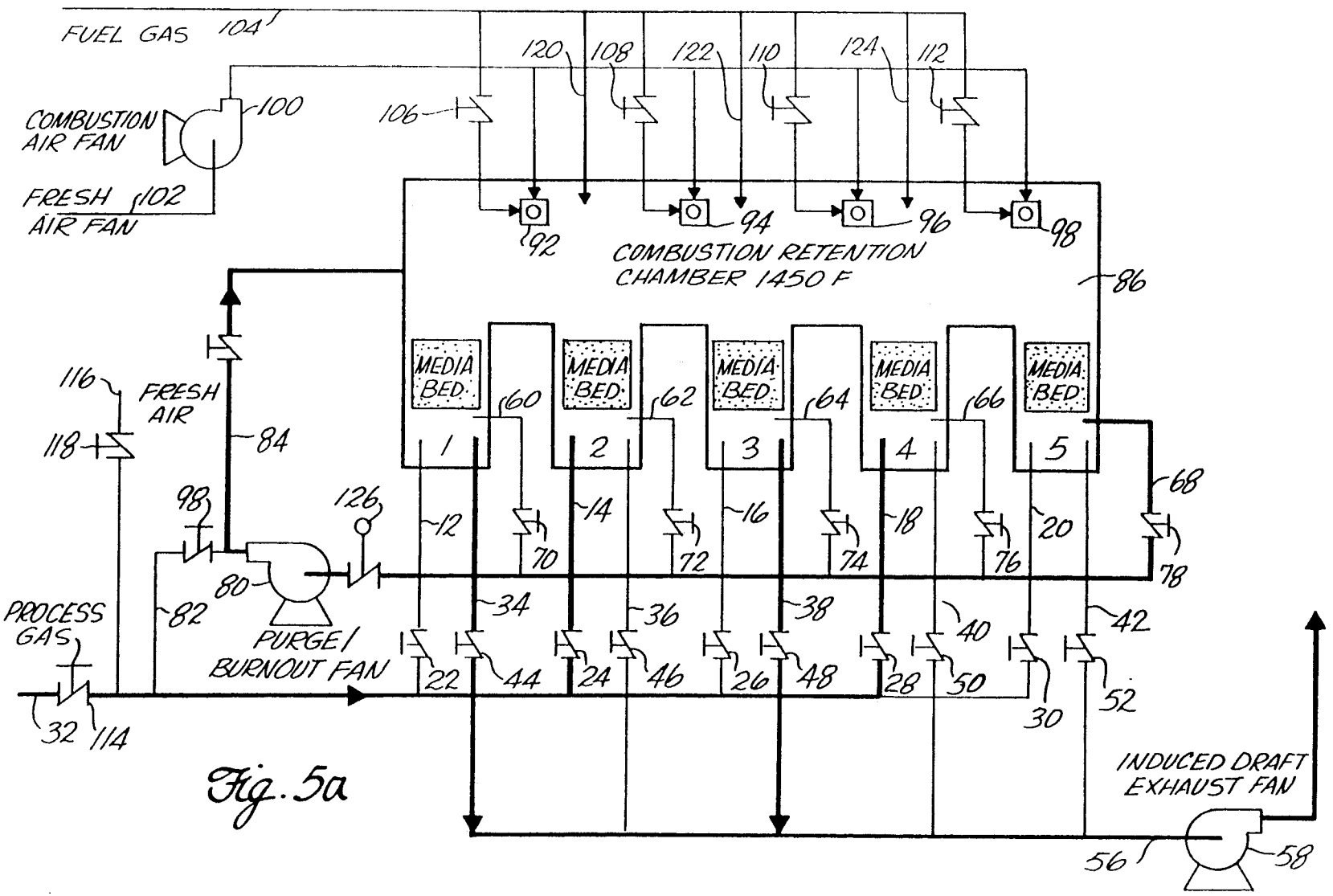
Figure 5B:
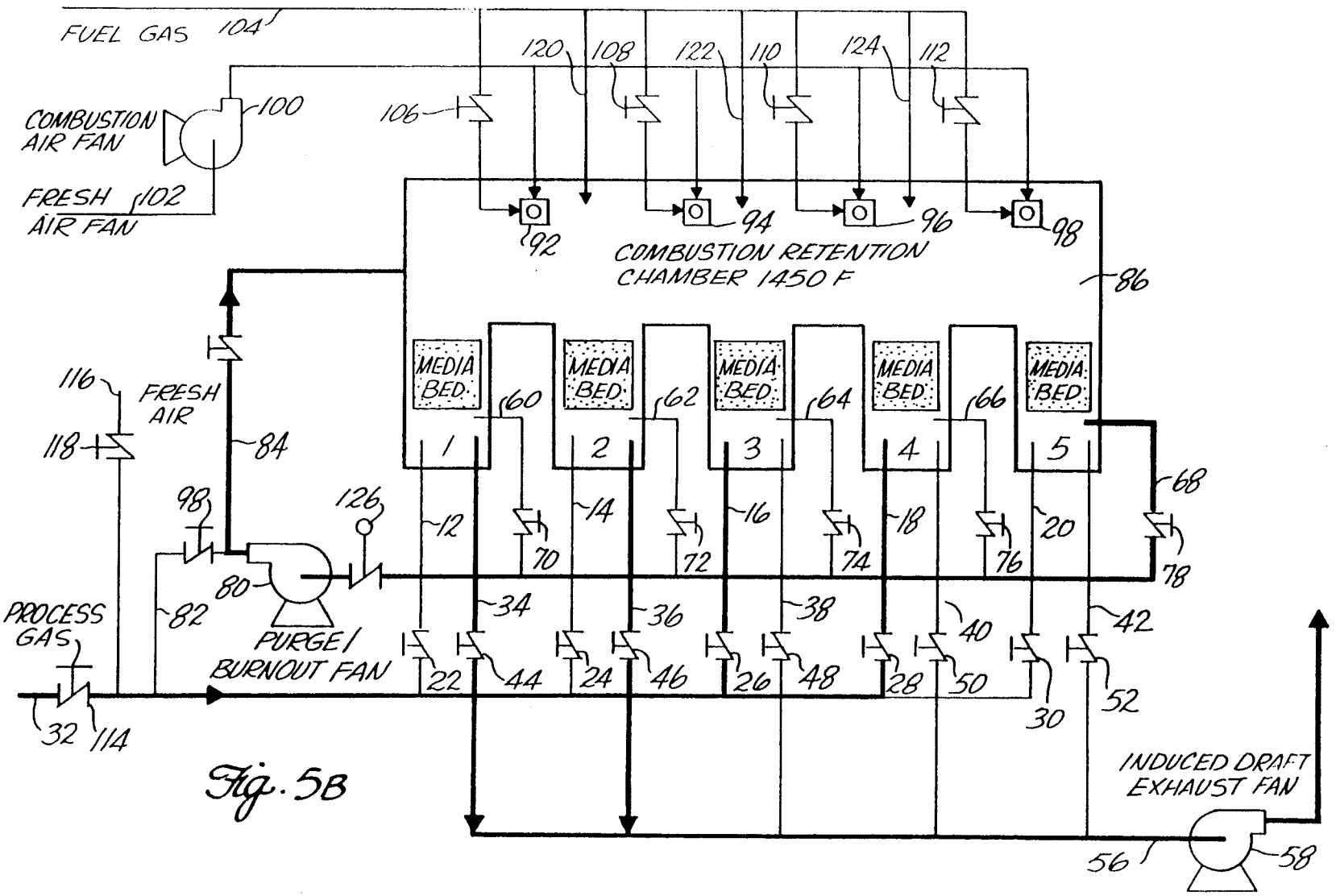
Figure 5C:
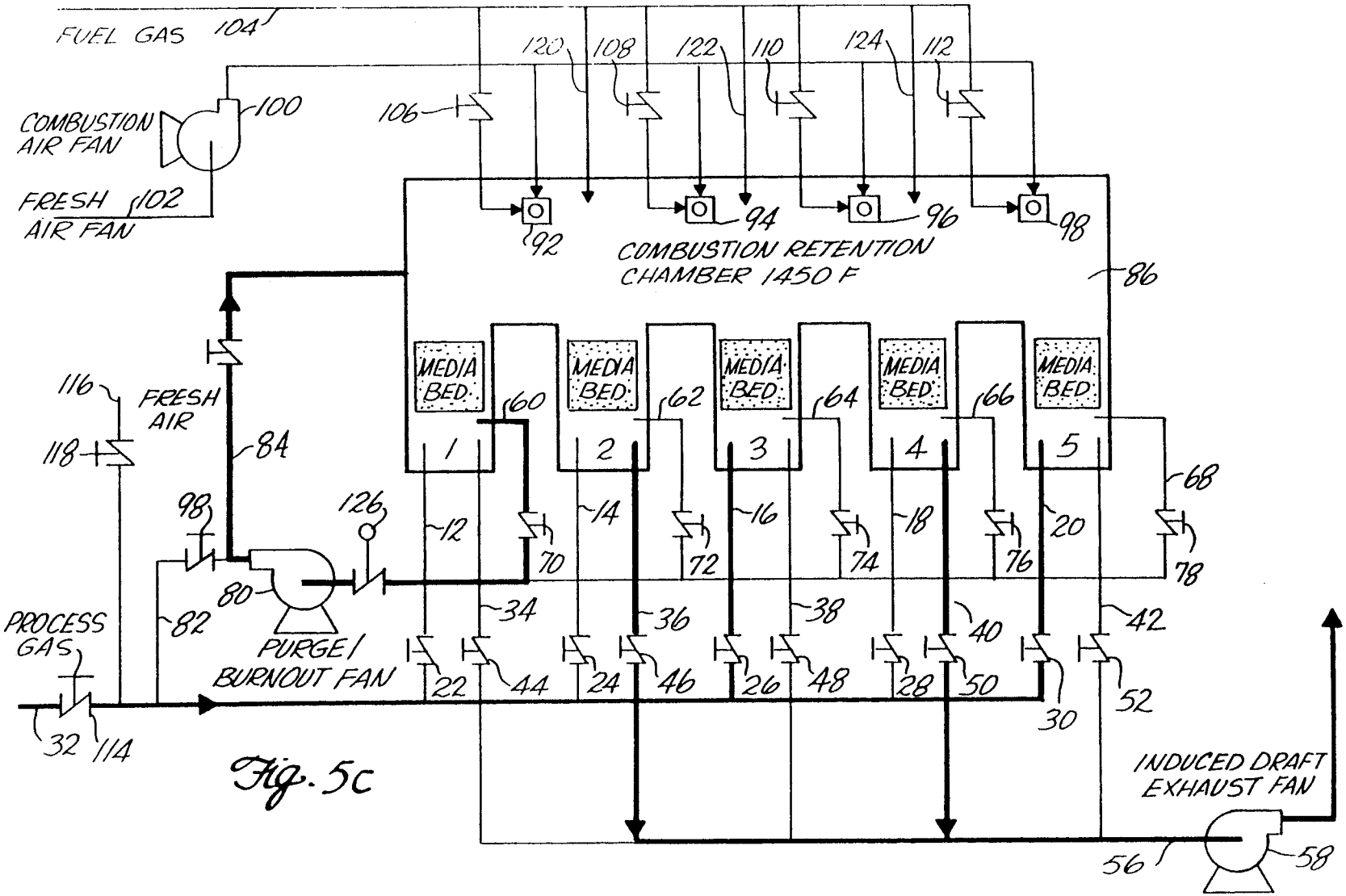

A second mode for burnout of the system allowing continued flow of process gas through the system is demonstrated in Table III and FIGS. 5*a–c*. This burnout mode for regenerator 5 valves 30 and 52 are closed, while valve 78 is open allowing gas to be drawn from regenerator 5 through the purge/burnout fan for return to the combustion retention chamber. Process gas continues to flow through the intake conduit with regenerators 2 and 4 acting as inlet regenerators having valves 24 and 28 open, respectively, while regenerators 1 and 3 act as outlet regenerators with valves 44 and 48 open, respectively. This configuration is shown in FIG. 5*a* and the first line of Table III. Regenerators 2 and 3 cycle to outlet and inlet regenerators, respectively as shown in line 2 of Table III, wherein valve 24 is closed and valve 46 is opened for regenerator 2 and valve 26 is opened and valve 48 closed for regenerator 3. This configuration is shown in FIG. 5*b*. Regenerators 1, 2, 3, and 4 continue cycling as shown by Table III with regenerator 5 in the burnout mode until burnout temperature is reached in the plenum at the bottom of regenerator 5.

TABLE III

| REGENERATOR | 1 | 2 | 3 | 4 | 5 | |
|---|---|---|---|---|---|---|
| Inlet flow at max. capacity | I | I | O | O | P | Normal |
| | P | I | I | O | O | Incineration Mode |
| Regenerator #5 Maximum inlet flow up to max. capacity | O | I | O | I | B | Burnout |
| | O | O | I | I | B | Mode |
| | I | O | O | I | B | (continues |
| | O | I | O | I | B | until burnout |
| | O | O | I | I | B | temp. reached |
| | . | . | . | . | . | then advance |
| | . | . | . | . | . | to next media |
| | . | . | . | . | . | bed) |
| | O | O | I | I | B | |

TABLE III-continued

| REGENERATOR | 1 | 2 | 3 | 4 | 5 | |
|---|---|---|---|---|---|---|
| Regenerator #1 | B | O | I | O | I | |
| | B | O | O | I | I | |
| | B | I | O | O | I | |
| | B | O | I | O | I | |
| | B | O | O | I | I | |
| | . | . | . | . | . | |
| | . | . | . | . | . | |
| | . | . | . | . | . | |
| | B | O | O | I | I | |
| Regenerator #2 | I | B | O | I | O | |
| | I | B | O | O | I | |
| | I | B | I | O | O | |
| | I | B | O | I | O | |
| | I | B | O | O | I | |
| | . | . | . | . | . | |
| | . | . | . | . | . | |
| | . | . | . | . | . | |
| | I | B | O | O | I | |
| Regenerator #3 | O | I | B | O | I | |
| | I | I | B | O | O | |
| | O | I | B | I | O | |
| | O | I | B | O | I | |
| | I | I | B | O | O | |
| | . | . | . | . | . | |
| | . | . | . | . | . | |
| | . | . | . | . | . | |
| | I | I | B | O | O | |
| Regenerator #4 | I | O | I | B | O | |
| | O | I | I | B | O | |
| | O | O | I | B | I | |
| | I | O | I | B | O | |
| | O | I | I | B | O | |
| | . | . | . | . | . | |
| | . | . | . | . | . | |
| | . | . | . | . | . | |
| | O | I | I | B | O | |
| | O | P | I | I | O | Normal |
| | O | O | P | I | I | Cycling |
| | I | O | O | P | I | |

I = INLET
O = OUTLET
B = BURNOUT

Regenerator 1 then becomes the burnout regenerator at the conclusion of an outlet cycle, while regenerator 5 becomes an inlet regenerator as shown in the first line of the regenerator 1 burnout cycle of Table III. This flow configuration is shown in FIG. 5*c*, wherein valves 22 and 44 are closed and valve 70 is open with respect to regenerator 1 allowing gas to be drawn through the purge/burnout fan and into the retention chamber. Regenerator 2 is configured as an outlet regenerator with valves 24 and 72 closed and valve 46 open. Regenerator 3 is an inlet regenerator with valves 48 and 74 closed and valve 26 open. Regenerator 4 is an outlet regenerator having valves 28 and 76 closed with valve 50 open, while regenerator 5, which has just completed its burnout cycle, becomes an inlet regenerator for cool down, having valves 52 and 78 closed, with valve 30 open to receive process gas. Operation of the present invention in the burnout mode, as shown in Table III requires absence of a purge cycle thereby allowing release of unoxidized process gas during flow reversal.

A controller source program for operation of the system, as embodied in the drawings, for system burnout is attached hereto as Appendix A.

Having now described the invention in detail as required by the patent statute, those skilled in the art will recognize modifications and substitutions to the embodiments disclosed herein for specific process applications. Such modifications and substitutions are within the scope and intent of the present invention as defined in the following claims.

APPENDIX A

MASONITE REGENERATIVE THERM

```
>>> OXIDIZER READY TO ACCEPT PROCESS FUMES.                    <<<

FILE
  2

RUNG  OXIDIZER  OXIDIZER                                        OXIDIZER
 33   READY     BURNOUT                                         READY TO
      DELAY     CYCLE ON                                        ACCEPT
        t4:       b3/                                           FUME
                                                                e:03.10
     +---] [-------]/[-------------------------------------------+---( )---+
      011.DN      161                                           |
       2,32      2,229                                          |
                                                                |
                                                                |
                                                                
```

```
                                                                                                  OXIDIZER
                                                                                                  INLET
                                                                                OXIDIZER          ISOLATION OXIDIZER
                                                                                READY TO          DAMPER    IDLE
                                                                                ACCEPT            OPEN      MODE
                                                                                FUME              i:01.02   b3/
                                                                                e:03.10
                                                                              +---] [-------]/[-------( )---+
                                                                                2,33                      63

                                                                                                  OXIDIZER
                                                                                                  INLET
                                                                                OXIDIZER          ISOLATION OXIDIZER
                                                                                READY TO          DAMPER    OXIDIZE
                                                                                ACCEPT            OPEN      MODE
                                                                                FUME              i:01.02   b3/
                                                                                e:03.10
                                                                              +---] [-------] [-------( )---+
                                                                                2,33                      70

$b003/00062  ... OXIDIZER  PREHEAT   MODE
             2,42*
$b003/00063  ... OXIDIZER  IDLE      MODE
             2,42*
$b003/00070  ... OXIDIZER  OXIDIZE   MODE
             2,42*

        >>> DRIVE THE CANISTER PURGE DAMPERS TO THE CLOSED      <<<
        >>> POSITION UNTIL THE OXIDIZER IS READY TO ACCEPT      <<<
        >>> FUME.                                                <<<

FILE
  2
                                                                                                  CLOSE
                                                                                                  CANISTER
                                                                                                  PURGE
                                                                                                  DAMPERS
RUNG          OXIDIZER
  45          READY
OXIDIZER      DELAY
ID FAN ON
 i:02.07      t4:                                                                                 b3/
+---] [---+---]/[-----------+-------------------------------------------------------------------( )---+
          |                                                                                        14
          | 011.EN
          |  2,32
          |
          |
          |
          |          CLOSE
          | CYCLE    CANISTER
          | DURATION PURGE
          | TIMER    DAMPERS
          |   t4:      b3/
          +---]/[-------] [---+
          | 015.DN      14   |
          |  2,51      2,45  |
          |                  |
          | PURGE            |
          | BURNOUT          |
          | FAN              |
          | HIGH TEMP        |
          | SHUTDOWN         |
          |   b3/            |
          +---] [------------+
              72
             2,188

$b003/00014  ... CLOSE     CANISTER  PURGE     DAMPERS
                 2,45      2,45*     2,58      2,59      2,60      2,61      2,62      2,72      2,81
                 2,90      2,99      2,108     2,113-    2,114-    2,119-    2,120-    2,125-    2,126-
                 2,131-    2,132-    2,137-    2,138-

        >>> BURNOUT CYCLE DAMPER SOLENOID VALVE.                <<<

FILE
  2                                                                                               BURNOUT
PURGE                                                                                             CYCLE
BURNOUT                                                                                           DAMPER
FAN          OXIDIZER                                                                             SOLENOID
RUNG
  46
HIGH TEMP    BURNOUT                                                                              VALVE
SHUTDOWN     CYCLE ON                                                                             e:03.17
  b3/          b3/
+---]/[-------] [-----------------------------------------------------------------------------------( )---+
  72           161
 2,188        2,229

$e000:003.17 ... BURNOUT   CYCLE     DAMPER    SOLENOID  VALVE
                 2,46*     2,145
```

```
>>> PURGE CYCLE DAMPER SOLENOID VALVE.                                    <<<

FILE
  2
RUNG
 47  PURGE
     BURNOUT
     FAN
     HIGH TEMP
     SHUTDOWN
       b3/                                                                 PURGE
     ---] [---+------------------------------------------------------------CYCLE
       72                                                                  DAMPER
      2,188                                                                SOLENOID
                                                                           VALVE
                                                                            o:03.16
                                                                          ---( )---
     OXIDIZER
     BURNOUT
     CYCLE ON
       b3/
     ---] [---
       161
      2,229

     $o000:003.16 ... PURGE     CYCLE     DAMPER    SOLENOID  VALVE
                   2,47*      2,142

>>> OPEN ALL CANISTER SEQUENCING DAMPERS.                                 <<<

FILE
  2
RUNG
 48  OXIDIZER                                                   +--MOV--------------------+
     ID FAN ON                                                  | MOVE                    |
      i:02.07                                                   | SOURCE                0 |
     ---]/[---+-------------------------------------------------+                         |
                                                                | DEST            $r6:OPOS |
                                                                |                       0 |
                                                                +-------------------------+
     HYDRAULIC
     PUMP ON
      i:01.12
     ---] [---
     OXIDIZER
     OUTLET
     HIGH TEMP
     SHUTDOWN
       b3/
     ---] [---
       69
      2,185

     $r006:000    ... CANISTER  DAMPER    SEQUENCER
                  2,48*      2,50*      2,53*

>>> INITIATE CANISTER DAMPER SEQUENCING.                                  <<<

FILE
  2
                                BURNOUT
                              OXIDIZER  CYCLE
RUNG                          OUTLET    DURATION                         +--TON--------------------+
 49  OXIDIZER  HYDRAULIC      HIGH TEMP TIMER                            | TIMER ON DELAY          |
     ID FAN ON PUMP ON        SHUTDOWN  ENABLE                           |                         |
      i:02.07   i:01.12         b3/       b3/                            | TIMER           $t4:14 +--(EN)--+
     ---] [-------] [-------]/[-------]/[-------------------------------+                         |
                                69        149                             | TIME BASE (SEC)    0.01 +--(DN)--+
                               2,185     2,231                            |                         |
                                                                          | PRESET             100  |
                                                                          |                         |
                                                                          | ACCUM                0  |
                                                                          +-------------------------+

     $t004:014    ... DAMPER    SEQUENC-  ING       INITIATE  TIMER
                  2,49*      2,50       2,51
```

```
>>> OXIDIZER FIVE POSITION CANISTER DAMPER SEQUENCER   <<<
>>> WITH 32 SECOND CYCLE TIME AND 23 SECOND TRANSITION <<<
>>> TIME.                                              <<<

FILE
  2

RUNG   OXIDIZER      BURNOUT
  50   CYCLE         CYCLE
       ADVANCE       DURATION
         b3/         TIMER
       +---] [-------+---]/[-----------------------------------------+--SQO----------------------+
         20          |  149                                          |  SEQUENCER OUTPUT         |
        2,52         |  2,231                                        |  FILE          #$n7:0 +--(EN)--+
                     |                                               |  MASK             7FFF +--(DN)--+
                     |                                               |  DEST           $n7:7         |
       DAMPER        |                                               |  CONTROL        $r6:0         |
       SEQUENC-      |                                               |  LENGTH             5         |
       ING       DAMPER                                              |  POSITION           0         |
       INITIATE  SEQUENCER                                           +-------------------------+
       TIMER     INITIATE |
         t4:       b3/    |
       +---] [------[ONS]--+
        014.DN     134    |
        2,49              |
                          |
       OXIDIZER           |
       ID FAN ON          |
        i:02.07           |
       +---]/[------------+
                          |
                          |
       HYDRAULIC          |
       PUMP ON            |
        i:01.12           |
       +---]/[------------+
                          |
                          |
       OXIDIZER           |
       OUTLET             |
       HIGH TEMP          |
       SHUTDOWN           |
         b3/              |
       +---] [------------+
         69               |
        2,185             |

        $r006:000   ... CANISTER  DAMPER    SEQUENCER
                    2,48*     2,50*     2,53*
        #$n007:000  ... CANISTER  DAMPER    SEQUENCER STARTUP   POSITION
                    2,50*
        $n007:007   ... CANISTER  DAMPER    SEQUENCER OUTPUT
                    2,50*     2,64      2,65      2,66-     2,67      2,68      2,69-     2,70      2,71
                    2,72-     2,73      2,74      2,75-     2,76      2,77      2,78-     2,79      2,80
                    2,81-     2,82      2,83      2,84-     2,85      2,86      2,87-     2,88      2,89
                    2,90-     2,91      2,92      2,93-     2,94      2,95      2,96-     2,97      2,98
                    2,99-     2,100     2,101     2,102-    2,103     2,104     2,105-    2,106      ...
```

```
>>> OXIDIZER CANISTER DAMPER SEQUENCER CYCLE DURATION  <<<
>>> TIMER.                                             <<<

FILE
  2

RUNG   DAMPER      DAMPER      DAMPER
  51   CYCLE       CYCLE       SEQUENC-
       RESET       RESET       ING
         t4:         t4:       INITIATE
       +---]/[-------]/[---+---] [-----------------------------------+--TON----------------------+
        084.EN     085.DN   |  014.EN                                 |  TIMER ON DELAY           |
        2,63       2,63     |  2,49                                   |  TIMER          $t4:15 +--(EN)--+
                            |                                         |  TIME BASE (SEC)      1.0 +--(DN)--+
                            |                                         |  PRESET              32         |
                            |                                         |  ACCUM                0         |
       DAMPER       DAMPER  |                                         +-------------------------+
       CYCLE        CYCLE   |
       RESET        RESET   |
         t4:          t4:   |
```

```
+---] [-------] [---+
| 084.DN    085.EN
|  2,63      2,63
|
|  $t004:015    ... CYCLE     DURATION  TIMER
|                2,45-      2,51*      2,52       2,231
|
|          >>> VERIFY OXIDIZER CANISTER DAMPER POSITIONS AND      <<<
|          >>> DURATION TIME AND ADVANCE TO THE NEXT CYCLE.        <<<
|
| FILE
|   2
|
| RUNG  CYCLE     DAMPER                                                    OXIDIZER
|   52  DURATION  CYCLE                                                     CYCLE
|       TIMER     RESET                                                     ADVANCE
|         t4:       t4:                                                       b3/
| +---] [-------] [---+-------------------------------------------------------( )---+
| | 015.DN    084.DN |                                                          20
| |  2,51      2,63  |
| |                  |
| |                  |
| | CYCLE            |
| | ADVANCE          |
| | TIMER            |
| |   t4:            |
| +---] [-------------+
| | 077.DN
| |  2,53
| |
| |  $b003/00020  ... OXIDIZER  CYCLE     ADVANCE
| |                2,50       2,52*      2,54
| |
| |
| |          >>> ADVANCE CANISTER DAMPERS TO NEXT CYCLE IF CYCLE     <<<
| |          >>> DURATION TIME IS EXTENDED.                          <<<
| |
| | FILE
| |   2
| |                                 BURNOUT
| |                                 CYCLE
| | RUNG  +--NEQ-----------------+  DURATION                +--TON----------------------+
| |   53  |                      |  TIMER                  |                            |
| |       | NOT EQUAL            |  ENABLE                 | TIMER ON DELAY             |
| |       |                      |    b3/                  |                            |
| | +---> | SOURCE A     $r6:0POS +------]/[-------------------+ TIMER            $t4:77 +--(EN)--+
| |       |                    0 |    149                  |                            |
| |       |                      |   2,231                 | TIME BASE (SEC)       1.0 +--(DN)--+
| |       | SOURCE B           0 |                         | PRESET                 70  |
| |       |                      |                         | ACCUM                   0  |
| |       +----------------------+                         +----------------------------+
| |
| |  $r006:000    ... CANISTER  DAMPER    SEQUENCER
| |                2,48*      2,50*      2,53*
| |  $t004:077    ... CYCLE     ADVANCE   TIMER
| |                2,52       2,53*      2,54*      2,55       2,56       2,63
| |
| |          >>> RESET CYCLE ADVANCE TIMER ON EACH CYCLE ADVANCE.    <<<
| |
| | FILE
| |   2
| |
| | RUNG  OXIDIZER  CYCLE                                                     CYCLE
| |   54  CYCLE     ADVANCE                                                   ADVANCE
| |       ADVANCE   RESET                                                     TIMER
| |         b3/       b3/                                                       $t4:77
| | +---] [------[ONS]-------------------------------------------------------(RES)--+
| |   20        145
| |  2,52
| |
| |  $t004:077    ... CYCLE     ADVANCE   TIMER
| |                2,52       2,53*      2,54*      2,55       2,56       2,63
```

```
>>> CANISTER 1 INLET DAMPER CLOSING AND OPENING DELAY. <<<

FILE
  2

RUNG  CANISTR 1
  64  INLET
      DAMPER
        n7:
     +---] [-----------------------------------------------------------+---> TON----------------------+
      007.00                                                           |   | TIMER ON DELAY           |
       2,50                                                            |   | TIMER            $t4:16  +--(EN)-->
                                                                       |   | TIME BASE (SEC)    0.01  +--(DN)-->
                                                                       |   | PRESET             1200  |
                                                                       |   | ACCUM                 0  |
                                                                       |   +--------------------------+
                                                                       |
                                                                       |   +--TOF----------------------+
                                                                       |   | TIMER OFF DELAY          |
                                                                       +---> TIMER            $t4:17  +--(EN)-->
                                                                           | TIME BASE (SEC)    0.01  +--(DN)-->
                                                                           | PRESET             1300  |
                                                                           | ACCUM              1300  |
                                                                           +--------------------------+

      $t004:016    ... CANISTR 1 INLET    DAMPER    DELAY    CLOSE
                   2,64*        2,66
      $t004:017    ... CANISTR 1 INLET    DAMPER    DELAY    OPEN
                   2,64*        2,66

>>> VERIFY CANISTER 1 INLET DAMPER CLOSING AND OPENING <<<

FILE
  2

RUNG  CANISTR 1
  65  INLET
      DAMPER
        n7:
     +---] [-----------------------------------------------------------+---> TON----------------------+
      007.00                                                           |   | TIMER ON DELAY           |
       2,50                                                            |   | TIMER            $t4:18  +--(EN)-->
                                                                       |   | TIME BASE (SEC)    0.01  +--(DN)-->
                                                                       |   | PRESET               27  |
                                                                       |   | ACCUM                 0  |
                                                                       |   +--------------------------+
                                                                       |
                                                                       |   +--TOF----------------------+
                                                                       |   | TIMER OFF DELAY          |
                                                                       +---> TIMER            $t4:19  +--(EN)-->
                                                                           | TIME BASE (SEC)    0.01  +--(DN)-->
                                                                           | PRESET               27  |
                                                                           | ACCUM                27  |
                                                                           +--------------------------+
```

```
$t004:018    ... VERIFY    CANISTR 1 INLET    DAMPER    CLOSING
             2,65*     2,109     2,109-    2,110
$t004:019    ... VERIFY    CANISTR 1 INLET    DAMPER    OPENING
             2,65*     2,109-    2,110-    2,110
```

>>> CANISTER 1 INLET DAMPER SOLENOID VALVE. <<<

```
FILE
  2
RUNG  CANISTR 1                                                          CANISTR 1
 66   INLET                                                              INLET
      DAMPER                                                             DAMPER
      DELAY                                                              SOLENOID
      CLOSE                                                              VALVE
        t4:                                                               o:02.01
     +---] [-------------+-------------------------------------------------------( )---+
     | 016.DN            |
     |  2,64             |
     |                   |
     |          CANISTR 1|
     |          INLET    |
     | CANISTR 1 DAMPER  |
     | INLET     DELAY   |
     | DAMPER    OPEN    |
     |   n7:       t4:   |
     +---]/[-------] [---+
     | 007.00    017.DN  |
     |  2,50      2,64   |
     |                   |
     | CANISTER          |
     | OUTLET            |
     | HIGH HIGH         |
     | TEMP              |
     |   b3/             |
     +---] [-------------+
       202
      2,209

      $o000:002.01 ... CANISTR 1 INLET    DAMPER    SOLENOID  VALVE
                   2,66*
```

>>> CANISTER 1 OUTLET DAMPER CLOSING AND OPENING DELAY <<<

```
FILE
  2

RUNG  CANISTR 1                                                  +--TON----------------------+
 67   OUTLET                                                     |                           |
      DAMPER                                                     | TIMER ON DELAY            |
        n7:                                                      |                           |
     +---] [-------------------------------------------------+---+ TIMER            $t4:23 +--(EN)--+
     | 007.01                                                |   |                           |
     |  2,50                                                 |   | TIME BASE (SEC)     0.01 +--(DN)--+
     |                                                       |   |                           |
     |                                                       |   | PRESET                 0  |
     |                                                       |   |                           |
     |                                                       |   | ACCUM                  0  |
     |                                                       |   |                           |
     |                                                       |   +---------------------------+
     |                                                       |
     |                                                       |
     |                                                       |   +--TOF----------------------+
     |                                                       |   |                           |
     |                                                       |   | TIMER OFF DELAY           |
     |                                                       +---+ TIMER            $t4:20 +--(EN)--+
     |                                                       |   |                           |
     |                                                       |   | TIME BASE (SEC)     0.01 +--(DN)--+
     |                                                       |   |                           |
     |                                                       |   | PRESET               100  |
     |                                                       |   |                           |
     |                                                       |   | ACCUM                100  |
     |                                                       |   |                           |
     |                                                       |   +---------------------------+
     |
     |
     |
```

```
>>> VERIFY CANISTER 1 OUTLET DAMPER CLOSING AND          <<<
>>> OPENING.                                              <<<

FILE
  2

RUNG  CANISTR 1
 68   OUTLET
      DAMPER
        n7:
     ---] [-----------------------------------------------------------+--TON----------------------+
      007.01                                                          |  TIMER ON DELAY           |
       2,50                                                           |  TIMER            St4:21  +--(EN)--+
                                                                      |  TIME BASE (SEC)     1.0  +--(DN)--+
                                                                      |  PRESET               15  |
                                                                      |  ACCUM                 0  |
                                                                      +--------------------------+

                                                                      +--TOF----------------------+
                                                                      |  TIMER OFF DELAY          |
                                                                      |  TIMER            St4:22  +--(EN)--+
                                                                      |  TIME BASE (SEC)     1.0  +--(DN)--+
                                                                      |  PRESET               15  |
                                                                      |  ACCUM                15  |
                                                                      +--------------------------+

      St004:021    ... VERIFY    CANISTR 1 OUTLET    DAMPER    CLOSING
                   2,68*      2,111      2,111-     2,112
      St004:022    ... VERIFY    CANISTR 1 OUTLET    DAMPER    OPENING
                   2,68*      2,111-     2,112-     2,112

>>> CANISTER 1 OUTLET DAMPER SOLENOID VALVE.                 <<<

FILE
  2  CANISTR 1                                                          CANISTR 1
     OUTLET                                                             OUTLET
RUNG DAMPER                                                             DAMPER
 69  DELAY                                                              SOLENOID
     CLOSE                                                              VALVE
       t4:                                                               o:02.02
     ---] [-----------------------------------------------------------------------------------( )---+
      023.DN
       2,67

                CANISTR 1
                OUTLET
      CANISTR 1 DAMPER
      OUTLET    DELAY
      DAMPER    OPEN
        n7:       t4:
     ---]/[-------] [---+
      007.01    020.DN
       2,50      2,67

      CANISTER
      OUTLET
      HIGH HIGH
      TEMP
        b3/
     ---] [-----------+
       202
      2,209

      So000:002.02 ... CANISTR 1 OUTLET    DAMPER    SOLENOID  VALVE
                   2,69*
```

```
>>> CANISTER 1 PURGE DAMPER CLOSING AND OPENING DELAY. <<<

FILE
  2

RUNG  CANISTR 1
  70  PURGE
      DAMPER
        n7:
      ---] [-----------------------------------------------------------+---+ TON----------------------+
       007.02                                                           |   | TIMER ON DELAY          |
        2,50                                                            |   | TIMER          $t4:24 +--(EN)--+
                                                                        |   | TIME BASE (SEC)   0.01 +--(DN)--+
                                                                        |   | PRESET            1200  |
                                                                        |   | ACCUM                0  |
                                                                        |   +-------------------------+
                                                                        |
                                                                        |   +--TOF----------------------+
                                                                        |   | TIMER OFF DELAY         |
                                                                        +---+ TIMER          $t4:25 +--(EN)--+
                                                                            | TIME BASE (SEC)   0.01 +--(DN)--+
                                                                            | PRESET            1300  |
                                                                            | ACCUM                0  |
                                                                            +-------------------------+

      $t004:024    ... CANISTR 1 PURGE     DAMPER    DELAY     CLOSE
                   2,70*       2,72
      $t004:025    ... CANISTR 1 PURGE     DAMPER    DELAY     OPEN
                   2,70*       2,72

>>> VERIFY CANISTER 1 PURGE DAMPER CLOSING AND OPENING <<<

FILE
  2

RUNG  CANISTR 1
  71  PURGE
      DAMPER
        n7:
      ---] [-----------------------------------------------------------+---+ TON----------------------+
       007.02                                                           |   | TIMER ON DELAY          |
        2,50                                                            |   | TIMER          $t4:26 +--(EN)--+
                                                                        |   | TIME BASE (SEC)    1.0 +--(DN)--+
                                                                        |   | PRESET             27  |
                                                                        |   | ACCUM              27  |
                                                                        |   +-------------------------+
                                                                        |
                                                                        |   +--TOF----------------------+
                                                                        |   | TIMER OFF DELAY         |
                                                                        +---+ TIMER          $t4:27 +--(EN)--+
                                                                            | TIME BASE (SEC)    1.0 +--(DN)--+
                                                                            | PRESET             27  |
                                                                            | ACCUM               0  |
                                                                            +-------------------------+
```

```
St004:026    ... VERIFY    CANISTR 1 PURGE    DAMPER    CLOSING
             2,71*     2,113     2,113-     2,114
St004:027    ... VERIFY    CANISTR 1 PURGE    DAMPER    OPENING
             2,71*     2,113-    2,114-     2,114

        >>> CANISTER 1 PURGE DAMPER SOLENOID VALVE.                <<<

FILE
  2
RUNG  CANISTR 1                                                    CANISTR 1
 72   PURGE                                                        PURGE
      DAMPER                                                       DAMPER
      DELAY                                                        SOLENOID
      CLOSE                                                        VALVE
        t4:                                                         o:02.03
     +---] [-------------+-------------------------------------------( )---+
     | 024.DN            |
     |  2,70             |
     |                   |
     |          CANISTR 1|
     |          PURGE    |
     | CANISTR 1 DAMPER  |
     | PURGE     DELAY   |
     | DAMPER    OPEN    |
     |   n7:       t4:   |
     +---]/[-------] [---+
     | 007.02    025.DN  |
     |  2,50      2,70   |
     |                   |
     | CLOSE             |
     | CANISTER          |
     | PURGE             |
     | DAMPERS           |
     |   b3/             |
     +---] [-------------+
     |   14              |
     |  2,45             |
     |                   |
     | CANISTER          |
     | OUTLET            |
     | HIGH HIGH         |
     | TEMP              |
     |   b3/             |
     +---] [-------------+
     |  202              |
     |  2,209            |
     |
     |  So000:002.03 ... CANISTR 1 PURGE    DAMPER    SOLENOID  VALVE
     |               2,72*

        >>> CANISTER 2 INLET DAMPER CLOSING AND OPENING DELAY. <<<

FILE
  2

RUNG  CANISTR 2                                          +--TON----------------------+
 73   INLET                                              |  TIMER ON DELAY           |
      DAMPER                                             |                           |
        n7:                                              |                           |
     +---] [-------------------------------------------+--+ TIMER          St4:28 +--(EN)--+
     | 007.03                                           |  |                           |
     |  2,50                                            |  | TIME BASE (SEC)    0.01 +--(DN)--+
     |                                                  |  |                           |
     |                                                  |  | PRESET             1200   |
     |                                                  |  |                           |
     |                                                  |  | ACCUM                 0   |
     |                                                  |  +---------------------------+
     |                                                  |
     |                                                  |
     |                                                  |
     |                                                  |
     |                                                  |
     |                                                  |
     |                                                  |
     |                                                  |  +--TOF----------------------+
     |                                                  |  |  TIMER OFF DELAY          |
     |                                                  |  |                           |
     |                                                  +--+ TIMER          St4:29 +--(EN)--+
     |                                                  |  |                           |
     |                                                  |  | TIME BASE (SEC)    0.01 +--(DN)--+
     |                                                  |  |                           |
     |                                                  |  | PRESET             1300   |
     |                                                  |  |                           |
     |                                                  |  | ACCUM              1300   |
     |                                                  |  +---------------------------+
```

```
$t004:028    ... CANISTR 2 INLET    DAMPER    DELAY    CLOSE
             2,73*      2,75
$t004:029    ... CANISTR 2 INLET    DAMPER    DELAY    OPEN
             2,73*      2,75
```

>>> VERIFY CANISTER 2 INLET DAMPER CLOSING AND OPENING <<<

```
FILE
  2

RUNG  CANISTR 2                                          +--TON----------------------+
  74  INLET                                              |                           |
      DAMPER                                             | TIMER ON DELAY            |
        n7:                                              |                           |
      +---] [-----------------------------------------+--+ TIMER            $t4:30 +--(EN)--+
      | 007.03                                         |  |                           |
      |  2,50                                          |  | TIME BASE (SEC)      1.0 +--(DN)--+
      |                                                |  |                           |
      |                                                |  | PRESET                27  |
      |                                                |  |                           |
      |                                                |  | ACCUM                  0  |
      |                                                |  |                           |
      |                                                |  +---------------------------+
      |                                                |
      |                                                |  +--TOF----------------------+
      |                                                |  |                           |
      |                                                |  | TIMER OFF DELAY           |
      |                                                |  |                           |
      |                                                +--+ TIMER            $t4:31 +--(EN)--+
      |                                                |  |                           |
      |                                                |  | TIME BASE (SEC)      1.0 +--(DN)--+
      |                                                |  |                           |
      |                                                |  | PRESET                27  |
      |                                                |  |                           |
      |                                                |  | ACCUM                 27  |
      |                                                |  |                           |
      |                                                |  +---------------------------+
      |
      |  $t004:030    ... VERIFY    CANISTR 2 INLET    DAMPER    CLOSING
      |               2,74*      2,115      2,115-     2,116
      |  $t004:031    ... VERIFY    CANISTR 2 INLET    DAMPER    OPENING
      |               2,74*      2,115-     2,116-     2,116
```

>>> CANISTER 2 INLET DAMPER SOLENOID VALVE. <<<

```
FILE
  2  CANISTR 2                                                                  CANISTR 2
     INLET                                                                      INLET
RUNG DAMPER                                                                     DAMPER
  75 DELAY                                                                      SOLENOID
     CLOSE                                                                      VALVE
       t4:                                                                       o:02.04
     +---] [-------------+-------------------------------------------------------------( )---+
     | 028.DN            |
     |  2,73             |
     |                   |
     |                   |
     |          CANISTR 2|
     |          INLET    |
     | CANISTR 2 DAMPER  |
     | INLET     DELAY   |
     | DAMPER    OPEN    |
     |   n7:       t4:   |
     +---]/[-------] [---+
     | 007.03    029.DN  |
     |  2,50      2,73   |
     |                   |
     |                   |
     | CANISTER          |
     | OUTLET            |
     | HIGH HIGH         |
     | TEMP              |
     |   b3/             |
     +---] [-------------+
       202
      2,209

      $o000:002.04 ... CANISTR 2 INLET    DAMPER    SOLENOID  VALVE
                   2,75*
```

```
>>> CANISTER 2 OUTLET DAMPER CLOSING AND OPENING DELAY <<<

FILE
  2

RUNG  CANISTR 2
 76   OUTLET
      DAMPER
        n7:
 ---] [-----------------------------------------------------------+--> TON----------------------+
      007.04                                                       |  TIMER ON DELAY            |
       2,50                                                        |  TIMER            $t4:76 --(EN)-->
                                                                   |  TIME BASE (SEC)     0.01 --(DN)-->
                                                                   |  PRESET                 0  |
                                                                   |  ACCUM                  0  |
                                                                   +----------------------------+

                                                                   +--> TOF----------------------+
                                                                   |  TIMER OFF DELAY           |
                                                                   |  TIMER            $t4:32 --(EN)-->
                                                                   |  TIME BASE (SEC)     0.01 --(DN)-->
                                                                   |  PRESET               100  |
                                                                   |  ACCUM                100  |
                                                                   +----------------------------+

      $t004:076    ... CANISTR 2 OUTLET    DAMPER    DELAY    CLOSE
                   2,76*      2,78
      $t004:032    ... CANISTR 2 OUTLET    DAMPER    DELAY    OPEN
                   2,76*      2,78

>>> VERIFY CANISTER 2 OUTLET DAMPER CLOSING AND          <<<
>>> OPENING.                                              <<<

FILE
  2

RUNG  CANISTR 2
 77   OUTLET
      DAMPER
        n7:
 ---] [-----------------------------------------------------------+--> TON----------------------+
      007.04                                                       |  TIMER ON DELAY            |
       2,50                                                        |  TIMER            $t4:33 --(EN)-->
                                                                   |  TIME BASE (SEC)      1.0 --(DN)-->
                                                                   |  PRESET                15  |
                                                                   |  ACCUM                  0  |
                                                                   +----------------------------+

                                                                   +--> TOF----------------------+
                                                                   |  TIMER OFF DELAY           |
                                                                   |  TIMER            $t4:34 --(EN)-->
                                                                   |  TIME BASE (SEC)      1.0 --(DN)-->
                                                                   |  PRESET                15  |
                                                                   |  ACCUM                 15  |
                                                                   +----------------------------+
```

```
$t004:033   ... VERIFY   CANISTR 2 OUTLET   DAMPER   CLOSING
            2,77*      2,117      2,117-     2,118
$t004:034   ... VERIFY   CANISTR 2 OUTLET   DAMPER   OPENING
            2,77*      2,117-     2,118-     2,118
```

>>> CANISTER 2 OUTLET DAMPER SOLENOID VALVE. <<<

```
FILE
  2
RUNG  CANISTR 2                                                          CANISTR 2
 78   OUTLET                                                             OUTLET
      DAMPER                                                             DAMPER
      DELAY                                                              SOLENOID
      CLOSE                                                              VALVE
        t4:                                                               o:02.05
     +---] [-------------+-------------------------------------------------------( )---+
      076.DN              |
       2,76               |
                          |
                CANISTR 2 |
                OUTLET    |
      CANISTR 2 DAMPER    |
      OUTLET    DELAY     |
      DAMPER    OPEN      |
        n7:       t4:     |
     +---]/[-------] [---+|
      007.04    032.DN    |
       2,50      2,76     |
                          |
      CANISTER            |
      OUTLET              |
      HIGH HIGH           |
      TEMP                |
        b3/               |
     +---] [-------------+|
        202               |
       2,209              |
```

```
$o000:002.05 ... CANISTR 2 OUTLET   DAMPER   SOLENOID  VALVE
             2,78*
```

>>> CANISTER 2 PURGE DAMPER CLOSING AND OPENING DELAY. <<<

```
FILE
  2

RUNG  CANISTR 2
 79   PURGE
      DAMPER
        n7:
     +---] [-----------------------------------------------------------+--+
      007.05                                                           |
       2,50                                                            |
                                                                       |
                                                                       |
                                                                       |
                                                                       |
                                                                       |
                                                                       |
                                                                       |
                                                                       |
                                                                       |
                                                                       |
                                                                       |
                                                                       |
                                                                       |
                                                                       |
                                                                       |
                                                                       |
                                                                       |
                                                                       |
                                                                       |
                                                                       |
                                                                       |
                                                                       |
                                                                       |
                                                                       |
                                                                       |
                                                                       |
                                                                       |
                                                                       |
                                                                       |
                                                                       |
```

```
+--TON-----------------------+
|  TIMER ON DELAY            |
|  TIMER              $t4:36 |---(EN)---+
|  TIME BASE (SEC)      0.01 |---(DN)---+
|  PRESET               1200 |
|  ACCUM                   0 |
+----------------------------+
```

```
+--TOF-----------------------+
|  TIMER OFF DELAY           |
|  TIMER              $t4:37 |---(EN)---+
|  TIME BASE (SEC)      0.01 |---(DN)---+
|  PRESET               1300 |
|  ACCUM                   0 |
+----------------------------+
```

```
$t004:036   ... CANISTR 2 PURGE   DAMPER   DELAY   CLOSE
            2,79*      2,81
$t004:037   ... CANISTR 2 PURGE   DAMPER   DELAY   OPEN
            2,79*      2,81
```

```
>>> VERIFY CANISTER 2 PURGE DAMPER CLOSING AND OPENING <<<

FILE
  2

RUNG  CANISTR 2                                                  +--TON----------------------+
 80   PURGE                                                      |                           |
      DAMPER                                                     | TIMER ON DELAY            |
        n7:                                                      |                           |
     +---] [-------------------------------------------------+---+ TIMER            $t4:38 +---(EN)---+
      007.05                                                     |                           |
       2,50                                                      | TIME BASE (SEC)      1.0 +---(DN)---+
                                                                 |                           |
                                                                 | PRESET                27  |
                                                                 |                           |
                                                                 | ACCUM                 27  |
                                                                 |                           |
                                                                 +---------------------------+

                                                                 +--TOF----------------------+
                                                                 |                           |
                                                                 | TIMER OFF DELAY           |
                                                                 |                           |
                                                              +--+ TIMER            $t4:39 +---(EN)---+
                                                                 |                           |
                                                                 | TIME BASE (SEC)      1.0 +---(DN)---+
                                                                 |                           |
                                                                 | PRESET                27  |
                                                                 |                           |
                                                                 | ACCUM                  0  |
                                                                 |                           |
                                                                 +---------------------------+

      $t004:038    ... VERIFY    CANISTR 2 PURGE     DAMPER    CLOSING
                   2,80*      2,119      2,119-     2,120
      $t004:039    ... VERIFY    CANISTR 2 PURGE     DAMPER    OPENING
                   2,80*      2,119-     2,120-     2,120

>>> CANISTER 2 PURGE DAMPER SOLENOID VALVE.                    <<<

FILE
  2   CANISTR 2                                                                          CANISTR 2
      PURGE                                                                              PURGE
RUNG  DAMPER                                                                             DAMPER
 81   DELAY                                                                              SOLENOID
      CLOSE                                                                              VALVE
        t4:                                                                               o:02.06
     +---] [-------------+-------------------------------------------------------------------( )---+
      036.DN             |
       2,79              |
                         |
                CANISTR 2|
                PURGE    |
CANISTR 2       DAMPER   |
PURGE           DELAY    |
DAMPER          OPEN     |
  n7:             t4:    |
     +---]/[-------] [---+
      007.05    037.DN   |
       2,50      2,79    |
                         |
                         |
CLOSE                    |
CANISTER                 |
PURGE                    |
DAMPERS                  |
  b3/                    |
     +---] [-------------+
  14                     |
 2,45                    |
                         |
                         |
CANISTER                 |
OUTLET                   |
HIGH HIGH                |
TEMP                     |
  b3/                    |
     +---] [-------------+
  202
 2,209

      $o000:002.06 ... CANISTR 2 PURGE     DAMPER    SOLENOID  VALVE
                   2,81*
```

```
>>> CANISTER 3 INLET DAMPER CLOSING AND OPENING DELAY. <<<

FILE
  2

RUNG  CANISTR 3
  82  INLET
      DAMPER
        n7:
     ---] [-----------------------------------------------------------+---+ TON----------------------+
      007.06                                                           |   | TIMER ON DELAY          |
       2,50                                                            |   | TIMER          St4:40 +--(EN)--+
                                                                       |   | TIME BASE (SEC)     0.01 +--(DN)--+
                                                                       |   | PRESET             1200 |
                                                                       |   | ACCUM                 0 |
                                                                       |   +-------------------------+
                                                                       |
                                                                       |   +--TOF----------------------+
                                                                       |   | TIMER OFF DELAY         |
                                                                       +---+ TIMER          St4:41 +--(EN)--+
                                                                           | TIME BASE (SEC)     0.01 +--(DN)--+
                                                                           | PRESET             1300 |
                                                                           | ACCUM              1300 |
                                                                           +-------------------------+

  St004:040   ... CANISTR 3 INLET    DAMPER   DELAY    CLOSE
              2,82*      2,84
  St004:041   ... CANISTR 3 INLET    DAMPER   DELAY    OPEN
              2,82*      2,84

>>> VERIFY CANISTER 3 INLET DAMPER CLOSING AND OPENING <<<

FILE
  2

RUNG  CANISTR 3
  83  INLET
      DAMPER
        n7:
     ---] [-----------------------------------------------------------+---+ TON----------------------+
      007.06                                                           |   | TIMER ON DELAY          |
       2,50                                                            |   | TIMER          St4:42 +--(EN)--+
                                                                       |   | TIME BASE (SEC)       1.0 +--(DN)--+
                                                                       |   | PRESET              27 |
                                                                       |   | ACCUM                 0 |
                                                                       |   +-------------------------+
                                                                       |
                                                                       |   +--TOF----------------------+
                                                                       |   | TIMER OFF DELAY         |
                                                                       +---+ TIMER          St4:43 +--(EN)--+
                                                                           | TIME BASE (SEC)       1.0 +--(DN)--+
                                                                           | PRESET              27 |
                                                                           | ACCUM               27 |
                                                                           +-------------------------+

  St004:042   ... VERIFY    CANISTR 3 INLET    DAMPER    CLOSING
              2,83*      2,121      2,121-     2,122
  St004:043   ... VERIFY    CANISTR 3 INLET    DAMPER    OPENING
              2,83*      2,121-     2,122-     2,122
```

```
>>> CANISTER 3 INLET DAMPER SOLENOID VALVE.                    <<<

FILE
  2
RUNG  CANISTR 3                                                  CANISTR 3
 84   INLET                                                      INLET
      DAMPER                                                     DAMPER
      DELAY                                                      SOLENOID
      CLOSE                                                      VALVE
        t4:                                                       o:02.07
     +---] [-------------+-------------------------------------------( )---+
     | 040.DN            |
     |  2,82             |
     |                   |
     |          CANISTR 3|
     |          INLET    |
     |CANISTR 3 DAMPER   |
     |INLET     DELAY    |
     |DAMPER    OPEN     |
     |   n7:       t4:   |
     +---1/[-------] [---+
     | 007.06    041.DN  |
     |  2,50      2,82   |
     |                   |
     |                   |
     |CANISTER           |
     |OUTLET             |
     |HIGH HIGH          |
     |TEMP               |
     |   b3/             |
     +---] [-------------+
       202
      2,209

      $o000:002.07 ... CANISTR 3 INLET     DAMPER    SOLENOID  VALVE
                   2,84*

>>> CANISTER 3 OUTLET DAMPER CLOSING AND OPENING DELAY <<<

FILE
  2

RUNG  CANISTR 3                                          +--TON----------------------+
 85   OUTLET                                             |  TIMER ON DELAY           |
      DAMPER                                             |                           |
        n7:                                              |  TIMER            $t4:79  +--(EN)--+
     +---] [-------------------------------------------+--+                          |
     | 007.07                                           |  TIME BASE (SEC)    0.01  +--(DN)--+
     |  2,50                                            |  PRESET                0  |
     |                                                  |  ACCUM                 0  |
     |                                                  +--------------------------+
     |                                                  |
     |                                                  |
     |                                                  |
```

```
>>> VERIFY CANISTER 3 OUTLET DAMPER CLOSING AND          <<<
>>> OPENING.                                              <<<

FILE
  2

RUNG  CANISTR 3
 86   OUTLET
      DAMPER
        n7:
      ---] [-----------------------------------------------------------+---+--TON----------------------+
       007.07                                                           |   | TIMER ON DELAY          |
        2,50                                                            |   | TIMER          $t4:45   +---(EN)---+
                                                                        |   | TIME BASE (SEC)     1.0  +---(DN)---+
                                                                        |   | PRESET               15 |
                                                                        |   | ACCUM                 0 |
                                                                        |   +-------------------------+

                                                                        |   +--TOF----------------------+
                                                                        |   | TIMER OFF DELAY         |
                                                                        +---+ TIMER          $t4:46   +---(EN)---+
                                                                            | TIME BASE (SEC)     1.0  +---(DN)---+
                                                                            | PRESET               15 |
                                                                            | ACCUM                15 |
                                                                            +-------------------------+

  $t004:045    ... VERIFY    CANISTR 3 OUTLET    DAMPER    CLOSING
                 2,86*      2,123      2,123-     2,124
  $t004:046    ... VERIFY    CANISTR 3 OUTLET    DAMPER    OPENING
                 2,86*      2,123-     2,124-     2,124

>>> CANISTER 3 OUTLET DAMPER SOLENOID VALVE.                <<<

FILE
  2  CANISTR 3                                                                                  CANISTR 3
     OUTLET                                                                                     OUTLET
RUNG DAMPER                                                                                     DAMPER
 87  DELAY                                                                                      SOLENOID
     CLOSE                                                                                      VALVE
       t4:                                                                                       o:02.10
     ---] [-------------+-------------------------------------------------------------------------( )---+
      079.DN            |
       2,85             |
                        |
                CANISTR 3
                OUTLET
     CANISTR 3  DAMPER  |
     OUTLET     DELAY   |
     DAMPER     OPEN    |
       n7:        t4:   |
     ---]/[-------] [---+
      007.07    044.DN  |
       2,50      2,85   |
                        |
     CANISTER           |
     OUTLET             |
     HIGH HIGH          |
     TEMP               |
       b3/              |
     ---] [-------------+
       202
      2,209

  $o000:002.10 ... CANISTR 3 OUTLET    DAMPER    SOLENOID  VALVE
                 2,87*
```

```
>>> CANISTER 3 PURGE DAMPER CLOSING AND OPENING DELAY. <<<

FILE
  2

RUNG  CANISTR 3
  88  PURGE
      DAMPER
        n7:
     +---] [-----------------------------------------------------------+---+ TON----------------------+
      007.08                                                           |   | TIMER ON DELAY          |
       2,50                                                            |   | TIMER            St4:48 +--(EN)--+
                                                                       |   | TIME BASE (SEC)    0.01 +--(DN)--+
                                                                       |   | PRESET             1200 |
                                                                       |   | ACCUM                 0 |
                                                                       |   +-------------------------+
                                                                       |
                                                                       |   +--TOF----------------------+
                                                                       |   | TIMER OFF DELAY         |
                                                                       +---+ TIMER            St4:49 +--(EN)--+
                                                                           | TIME BASE (SEC)    0.01 +--(DN)--+
                                                                           | PRESET             1300 |
                                                                           | ACCUM                 0 |
                                                                           +-------------------------+

      St004:048    ... CANISTR 3 PURGE     DAMPER    DELAY     CLOSE
                   2,88*       2,90
      St004:049    ... CANISTR 3 PURGE     DAMPER    DELAY     OPEN
                   2,88*       2,90

>>> VERIFY CANISTER 3 PURGE DAMPER CLOSING AND OPENING <<<

FILE
  2

RUNG  CANISTR 3
  89  PURGE
      DAMPER
        n7:
     +---] [-----------------------------------------------------------+---+ TON----------------------+
      007.08                                                           |   | TIMER ON DELAY          |
       2,50                                                            |   | TIMER            St4:50 +--(EN)--+
                                                                       |   | TIME BASE (SEC)     1.0 +--(DN)--+
                                                                       |   | PRESET               27 |
                                                                       |   | ACCUM                27 |
                                                                       |   +-------------------------+
                                                                       |
                                                                       |   +--TOF----------------------+
                                                                       |   | TIMER OFF DELAY         |
                                                                       +---+ TIMER            St4:51 +--(EN)--+
                                                                           | TIME BASE (SEC)     1.0 +--(DN)--+
                                                                           | PRESET               27 |
                                                                           | ACCUM                 0 |
                                                                           +-------------------------+

      St004:050    ... VERIFY    CANISTR 3 PURGE     DAMPER    CLOSING
                   2,89*       2,125       2,125-    2,126
      St004:051    ... VERIFY    CANISTR 3 PURGE     DAMPER    OPENING
                   2,89*       2,125-      2,126-    2,126
```

```
>>> CANISTER 3 PURGE DAMPER SOLENOID VALVE.                    <<<

FILE
  2
RUNG  CANISTR 3                                                  CANISTR 3
 90   PURGE                                                      PURGE
      DAMPER                                                     DAMPER
      DELAY                                                      SOLENOID
      CLOSE                                                      VALVE
        t4:                                                       o:02.11
     +---] [-------------+-------------------------------------------( )---+
      048.DN
       2,88

                CANISTR 3
                PURGE
      CANISTR 3 DAMPER
      PURGE     DELAY
      DAMPER    OPEN
        n7:       t4:
     +---]/[-------] [---+
      007.08    049.DN
       2,50      2,88

      CLOSE
      CANISTER
      PURGE
      DAMPERS
        b3/
     +---] [-------------+
        14
       2,45

      CANISTER
      OUTLET
      HIGH HIGH
      TEMP
        b3/
     +---] [-------------+
        202
       2,209

       $o000:002.11 ... CANISTR 3 PURGE     DAMPER    SOLENOID  VALVE
                    2,90*

>>> CANISTER 4 INLET DAMPER CLOSING AND OPENING DELAY. <<<

FILE
  2

RUNG  CANISTR 4                                          +--TON----------------------+
 91   INLET                                              |  TIMER ON DELAY           |
      DAMPER                                             |                           |
        n7:                                              |  TIMER            $t4:52  +--(EN)--+
     +---] [-------------------------------------------+--+ TIME BASE (SEC)    0.01  +--(DN)--+
      007.09                                             |  PRESET             1200  |
       2,50                                              |  ACCUM                 0  |
                                                         +-------------------------+

                                                         +--TOF----------------------+
                                                         |  TIMER OFF DELAY          |
                                                         +--+ TIMER            $t4:53  +--(EN)--+
                                                            |  TIME BASE (SEC)    0.01  +--(DN)--+
                                                            |  PRESET             1300  |
                                                            |  ACCUM              1300  |
                                                            +-------------------------+

       $t004:052    ... CANISTR 4 INLET     DAMPER    DELAY     CLOSE
                    2,91*      2,93
       $t004:053    ... CANISTR 4 INLET     DAMPER    DELAY     OPEN
                    2,91*      2,93
```

```
>>> VERIFY CANISTER 4 INLET DAMPER CLOSING AND OPENING <<<

FILE
  2

RUNG  CANISTR 4                                          +--TON----------------------+
  92  INLET                                              |  TIMER ON DELAY           |
      DAMPER                                             |                           |
        n7:                                              |  TIMER            $t4:54  +--(EN)--+
    +---] [-------------------------------------------+--+  TIME BASE (SEC)     1.0  +--(DN)--+
      007.09                                             |  PRESET                27  |
       2,50                                              |  ACCUM                  0  |
                                                         +--------------------------+

                                                         +--TOF----------------------+
                                                         |  TIMER OFF DELAY          |
                                                         |                           |
                                                         +--+ TIMER            $t4:55  +--(EN)--+
                                                         |  TIME BASE (SEC)     1.0  +--(DN)--+
                                                         |  PRESET                27  |
                                                         |  ACCUM                 27  |
                                                         +--------------------------+

  $t004:054    ... VERIFY    CANISTR 4 INLET     DAMPER    CLOSING
                 2,92*      2,127      2,127-     2,128
  $t004:055    ... VERIFY    CANISTR 4 INLET     DAMPER    OPENING
                 2,92*      2,127-     2,128-     2,128

>>> CANISTER 4 INLET DAMPER SOLENOID VALVE.                <<<

FILE
  2  CANISTR 4                                                                  CANISTR 4
     INLET                                                                      INLET
RUNG DAMPER                                                                     DAMPER
  93 DELAY                                                                      SOLENOID
     CLOSE                                                                      VALVE
       t4:                                                                       o:02.12
    +---] [-------------+-------------------------------------------------------------( )---+
     052.DN             |
      2,91              |
                        |
                CANISTR 4
                INLET   |
     CANISTR 4 DAMPER   |
     INLET     DELAY    |
     DAMPER    OPEN     |
       n7:       t4:    |
    +---]/[-------] [---+
     007.09    053.DN   |
      2,50      2,91    |
                        |
     CANISTER           |
     OUTLET             |
     HIGH HIGH          |
     TEMP               |
       b3/              |
    +---] [-------------+
       202
      2,209

      $o000:002.12 ... CANISTR 4 INLET     DAMPER    SOLENOID  VALVE
                     2,93*
```

```
>>> CANISTER 4 OUTLET DAMPER CLOSING AND OPENING DELAY <<<

FILE
  2

RUNG  CANISTR 4
 94   OUTLET
      DAMPER
        n7:
      ---] [-----------------------------------------------------------+--TON----------------------+
       007.10                                                          |  TIMER ON DELAY           |
        2,50                                                           |  TIMER            St4:59  +--(EN)--+
                                                                       |  TIME BASE (SEC)    0.01  +--(DN)--+
                                                                       |  PRESET                0  |
                                                                       |  ACCUM                 0  |
                                                                       +--------------------------+

                                                                       +--TOF----------------------+
                                                                       |  TIMER OFF DELAY          |
                                                                       +--> TIMER            St4:56  +--(EN)--+
                                                                       |  TIME BASE (SEC)    0.01  +--(DN)--+
                                                                       |  PRESET              100  |
                                                                       |  ACCUM               100  |
                                                                       +--------------------------+

      St004:059   ... CANISTR 4 OUTLET    DAMPER    DELAY    CLOSE
                  2,94*       2,96
      St004:056   ... CANISTR 4 OUTLET    DAMPER    DELAY    OPEN
                  2,94*       2,96

>>> VERIFY CANISTER 4 OUTLET DAMPER CLOSING AND          <<<
>>> OPENING.                                              <<<

FILE
  2

RUNG  CANISTR 4
 95   OUTLET
      DAMPER
        n7:
      ---] [-----------------------------------------------------------+--TON----------------------+
       007.10                                                          |  TIMER ON DELAY           |
        2,50                                                           |  TIMER            St4:57  +--(EN)--+
                                                                       |  TIME BASE (SEC)      1.0  +--(DN)--+
                                                                       |  PRESET               15  |
                                                                       |  ACCUM                15  |
                                                                       +--------------------------+

                                                                       +--TOF----------------------+
                                                                       |  TIMER OFF DELAY          |
                                                                       +--> TIMER            St4:58  +--(EN)--+
                                                                       |  TIME BASE (SEC)      1.0  +--(DN)--+
                                                                       |  PRESET               15  |
                                                                       |  ACCUM                15  |
                                                                       +--------------------------+

      St004:057   ... VERIFY    CANISTR 4 OUTLET    DAMPER    CLOSING
                  2,95*       2,129       2,129-      2,130
      St004:058   ... VERIFY    CANISTR 4 OUTLET    DAMPER    OPENING
                  2,95*       2,129-      2,130-      2,130
```

```
>>> CANISTER 4 OUTLET DAMPER SOLENOID VALVE.                    <<<

FILE
  2
RUNG  CANISTR 4                                                          CANISTR 4
 96   OUTLET                                                             OUTLET
      DAMPER                                                             DAMPER
      DELAY                                                              SOLENOID
      CLOSE                                                              VALVE
        t4:                                                               o:02.13
     +---] [-------------+-------------------------------------------------------( )---+
     | 059.DN            |                                                             |
     |  2,94             |                                                             |
     |                   |                                                             |
     |          CANISTR 4|                                                             |
     |          OUTLET   |                                                             |
     | CANISTR 4 DAMPER  |                                                             |
     | OUTLET    DELAY   |                                                             |
     | DAMPER    OPEN    |                                                             |
     |   n7:       t4:   |                                                             |
     +---]/[-------] [---+                                                             |
     | 007.10    056.DN  |                                                             |
     |  2,50      2,94   |                                                             |
     |                   |                                                             |
     | CANISTER          |                                                             |
     | OUTLET            |                                                             |
     | HIGH HIGH         |                                                             |
     | TEMP              |                                                             |
     |   b3/             |                                                             |
     +---] [-------------+                                                             |
     |   202             |                                                             |
     |  2,209            |                                                             |
     |                   |                                                             |
     |  $o000:002.13 ... CANISTR 4 OUTLET    DAMPER    SOLENOID  VALVE                 |
     |               2,96*                                                             |
     |                                                                                 |
     |                                                                                 |
     |                                                                                 
```

```
>>> VERIFY CANISTER 4 PURGE DAMPER CLOSING AND OPENING <<<

FILE
  2

RUNG  CANISTR 4
  98  PURGE
      DAMPER
        n7:
     ---] [-----------------------------------------------------------+--> TIMER          $t4:62 --(EN)-->
      007.11                                                          |   TIME BASE (SEC)    1.0 --(DN)-->
       2,50                                                           |   PRESET              27
                                                                      |   ACCUM               27
                                                                      |
                                                                      |   TIMER OFF DELAY
                                                                      +--> TIMER          $t4:63 --(EN)-->
                                                                          TIME BASE (SEC)    1.0 --(DN)-->
                                                                          PRESET              27
                                                                          ACCUM                0

  $t004:062    ... VERIFY    CANISTR 4 PURGE     DAMPER    CLOSING
                 2,98*      2,131      2,131-     2,132
  $t004:063    ... VERIFY    CANISTR 4 PURGE     DAMPER    OPENING
                 2,98*      2,131-     2,132-     2,132

>>> CANISTER 4 PURGE DAMPER SOLENOID VALVE.                    <<<

FILE
  2  CANISTR 4                                                                                CANISTR 4
     PURGE                                                                                    PURGE
RUNG DAMPER                                                                                   DAMPER
  99 DELAY                                                                                    SOLENOID
     CLOSE                                                                                    VALVE
       t4:                                                                                     o:02.14
    ---] [-------------+-------------------------------------------------------------------------( )-->
     060.DN            |
      2,97             |
                       |
                CANISTR 4
                PURGE  |
     CANISTR 4  DAMPER |
     PURGE      DELAY  |
     DAMPER     OPEN   |
       n7:        t4:  |
    ---]/[-------] [---+
     007.11     061.DN |
      2,50       2,97  |
                       |
     CLOSE             |
     CANISTER          |
     PURGE             |
     DAMPERS           |
       b3/             |
    ---] [-------------+
       14              |
      2,45             |
                       |
     CANISTER          |
     OUTLET            |
     HIGH HIGH         |
     TEMP              |
       b3/             |
    ---] [-------------+
       202             |
      2,209            |
                       |
      $o000:002.14 ... CANISTR 4 PURGE     DAMPER    SOLENOID  VALVE
                 2,99*
```

```
>>> CANISTER 5 INLET DAMPER CLOSING AND OPENING DELAY. <<<

FILE
  2

RUNG  CANISTR 5
 100  INLET
      DAMPER
        n7:
     ---] [-----------------------------------------------------------+--> TON----------------------+
      007.12                                                          |   | TIMER ON DELAY          |
       2,50                                                           |   |                         |
                                                                      |   | TIMER            St4:64 +--(EN)-->
                                                                      |   | TIME BASE (SEC)    0.01 +--(DN)-->
                                                                      |   | PRESET             1200 |
                                                                      |   | ACCUM                 0 |
                                                                      |   +-------------------------+
                                                                      |
                                                                      |   +--TOF----------------------+
                                                                      |   | TIMER OFF DELAY         |
                                                                      +--> TIMER            St4:65 +--(EN)-->
                                                                      |   | TIME BASE (SEC)    0.01 +--(DN)-->
                                                                      |   | PRESET             1300 |
                                                                      |   | ACCUM              1300 |
                                                                      |   +-------------------------+

      St004:064    ... CANISTR 5 INLET     DAMPER    DELAY     CLOSE
                   2,100*     2,102
      St004:065    ... CANISTR 5 INLET     DAMPER    DELAY     OPEN
                   2,100*     2,102

>>> VERIFY CANISTER 5 INLET DAMPER CLOSING AND OPENING <<<

FILE
  2

RUNG  CANISTR 5
 101  INLET
      DAMPER
        n7:
     ---] [-----------------------------------------------------------+--> TON----------------------+
      007.12                                                          |   | TIMER ON DELAY          |
       2,50                                                           |   |                         |
                                                                      |   | TIMER            St4:66 +--(EN)-->
                                                                      |   | TIME BASE (SEC)     1.0 +--(DN)-->
                                                                      |   | PRESET               27 |
                                                                      |   | ACCUM                 0 |
                                                                      |   +-------------------------+
                                                                      |
                                                                      |   +--TOF----------------------+
                                                                      |   | TIMER OFF DELAY         |
                                                                      +--> TIMER            St4:67 +--(EN)-->
                                                                      |   | TIME BASE (SEC)     1.0 +--(DN)-->
                                                                      |   | PRESET               27 |
                                                                      |   | ACCUM                27 |
                                                                      |   +-------------------------+

      St004:066    ... VERIFY    CANISTR 5 INLET     DAMPER    CLOSING
                   2,101*     2,133      2,133-     2,134
      St004:067    ... VERIFY    CANISTR 5 INLET     DAMPER    OPENING
                   2,101*     2,133-     2,134-     2,134
```

```
>>> CANISTER 5 INLET DAMPER SOLENOID VALVE.                                <<<

FILE
  2
RUNG  CANISTR 5                                                            CANISTR 5
 102  INLET                                                               INLET
      DAMPER                                                              DAMPER
      DELAY                                                               SOLENOID
      CLOSE                                                               VALVE
        t4:                                                                o:02.15
     +---] [-------------+-------------------------------------------------( )---+
     | 064.DN            |
     |  2,100            |
     |                   |
     |          CANISTR 5|
     |          INLET    |
     | CANISTR 5 DAMPER  |
     | INLET     DELAY   |
     | DAMPER    OPEN    |
     |   n7:       t4:   |
     +---]/[-------] [---+
     | 007.12    065.DN  |
     |  2,50      2,100  |
     |                   |
     |                   |
     | CANISTER          |
     | OUTLET            |
     | HIGH HIGH         |
     | TEMP              |
     |   b3/             |
     +---] [-------------+
     |   202
     |  2,209
     |
     |  $o000:002.15 ... CANISTR 5 INLET     DAMPER    SOLENOID  VALVE
     |               2,102*

>>> CANISTER 5 OUTLET DAMPER CLOSING AND OPENING DELAY <<<

FILE
  2

RUNG  CANISTR 5                                                  +--TON----------------------+
 103  OUTLET                                                     |                           |
      DAMPER                                                     | TIMER ON DELAY            |
        n7:                                                      |                           |
     +---] [-------------------------------------------------+---+ TIMER            $t4:71 +---(EN)---+
     | 007.13                                                  |                           |
     |  2,50                                                   | TIME BASE (SEC)      0.01 +---(DN)---+
     |                                                         |                           |
     |                                                         | PRESET                  0 |
     |                                                         |                           |
     |                                                         | ACCUM                   0 |
     |                                                         |                           |
     |                                                         +---------------------------+
     |
     |
     |
```

```
>>> VERIFY CANISTER 5 OUTLET DAMPER CLOSING AND          <<<
>>> OPENING.                                              <<<

FILE
  2

RUNG  CANISTR 5                                   +--TON----------------------+
 104  OUTLET                                      |                            |
      DAMPER                                      | TIMER ON DELAY             |
        n7:                                       |                            |
 +---] [--------------------------------------+---+ TIMER              $t4:69 +--(EN)--+
      007.13                                      |                            |
       2,50                                       | TIME BASE (SEC)       1.0  +--(DN)--+
                                                  |                            |
                                                  | PRESET                15   |
                                                  |                            |
                                                  | ACCUM                  0   |
                                                  +----------------------------+

                                                  +--TOF----------------------+
                                                  |                            |
                                                  | TIMER OFF DELAY            |
                                                  |                            |
                                                  +---+ TIMER              $t4:70 +--(EN)--+
                                                  |                            |
                                                  | TIME BASE (SEC)       1.0  +--(DN)--+
                                                  |                            |
                                                  | PRESET                15   |
                                                  |                            |
                                                  | ACCUM                 15   |
                                                  +----------------------------+

      $t004:069    ... VERIFY    CANISTR 5 OUTLET    DAMPER    CLOSING
                   2,104*     2,135      2,135-     2,136
      $t004:070    ... VERIFY    CANISTR 5 OUTLET    DAMPER    OPENING
                   2,104*     2,135-     2,136-     2,136

>>> CANISTER 5 OUTLET DAMPER SOLENOID VALVE.                <<<

FILE
  2  CANISTR 5                                                                CANISTR 5
     OUTLET                                                                   OUTLET
RUNG DAMPER                                                                   DAMPER
 105 DELAY                                                                    SOLENOID
     CLOSE                                                                    VALVE
       t4:                                                                     o:02.16
 +---] [-------------+-------------------------------------------------------------( )---+
     071.DN          |
      2,103          |
                     |
                CANISTR 5
                OUTLET
     CANISTR 5  DAMPER
     OUTLET     DELAY
     DAMPER     OPEN
       n7:        t4:
 +---]/[-------] [---+
     007.13    068.DN
      2,50      2,103
                     |
     CANISTER        |
     OUTLET          |
     HIGH HIGH       |
     TEMP            |
       b3/           |
 +---] [-------------+
       202
      2,209
       |
      $o000:002.16 ... CANISTR 5 OUTLET    DAMPER    SOLENOID  VALVE
                   2,105*
```

```
>>> CANISTER 5 PURGE DAMPER CLOSING AND OPENING DELAY. <<<

FILE
  2

RUNG  CANISTR 5
106   PURGE
      DAMPER
        n7:
      ---] [-----------------------------------------------------------+---+ TON----------------------+
      007.14                                                           |   | TIMER ON DELAY          |
       2,50                                                            |   | TIMER          $t4:72 +--(EN)--+
                                                                       |   | TIME BASE (SEC)    0.01 +--(DN)--+
                                                                       |   | PRESET             1200 |
                                                                       |   | ACCUM                 0 |
                                                                       |   +-------------------------+
                                                                       |
                                                                       |   +--TOF----------------------+
                                                                       |   | TIMER OFF DELAY         |
                                                                       +---+ TIMER          $t4:73 +--(EN)--+
                                                                           | TIME BASE (SEC)    0.01 +--(DN)--+
                                                                           | PRESET             1300 |
                                                                           | ACCUM                 0 |
                                                                           +-------------------------+

      $t004:072   ... CANISTR 5 PURGE    DAMPER    DELAY    CLOSE
                  2,106*     2,108
      $t004:073   ... CANISTR 5 PURGE    DAMPER    DELAY    OPEN
                  2,106*     2,108

>>> VERIFY CANISTER 5 PURGE DAMPER CLOSING AND OPENING <<<

FILE
  2

RUNG  CANISTR 5
107   PURGE
      DAMPER
        n7:
      ---] [-----------------------------------------------------------+---+ TON----------------------+
      007.14                                                           |   | TIMER ON DELAY          |
       2,50                                                            |   | TIMER          $t4:74 +--(EN)--+
                                                                       |   | TIME BASE (SEC)     1.0 +--(DN)--+
                                                                       |   | PRESET              27  |
                                                                       |   | ACCUM               27  |
                                                                       |   +-------------------------+
                                                                       |
                                                                       |   +--TOF----------------------+
                                                                       |   | TIMER OFF DELAY         |
                                                                       +---+ TIMER          $t4:74 +--(EN)--+
                                                                           | TIME BASE (SEC)     1.0 +--(DN)--+
                                                                           | PRESET              27  |
                                                                           | ACCUM               27  |
                                                                           +-------------------------+

      $t004:074   ... VERIFY    CANISTR 5 PURGE    DAMPER    CLOSING
                  2,107*     2,107*     2,137     2,137-     2,138
```

```
>>> CANISTER 5 PURGE DAMPER SOLENOID VALVE.                                <<<

FILE
  2
RUNG
108
CANISTR 5 PURGE DAMPER DELAY CLOSE t4:                                    CANISTR 5 PURGE DAMPER SOLENOID VALVE o:02.17
---] [-------------------------------------------------------------------------------------------------------( )---
072.DN 2,106
CANISTR 5 PURGE DAMPER n7:   CANISTR 5 PURGE DAMPER DELAY OPEN t4:
---]/[-------] [---
007.14 2,50   073.DN 2,106
CLOSE CANISTER PURGE DAMPERS b3/
---] [-------------
14 2,45
CANISTER OUTLET HIGH HIGH TEMP b3/
---] [-------------
202 2,209
$o000:002.17 ... CANISTR 5 PURGE    DAMPER    SOLENOID  VALVE
             2,108*

>>> OXIDIZER BURNOUT CYCLE INITIATED.                                     <<<

FILE
  2
RUNG
226
OXIDIZER BURNOUT CYCLE INITIATE (METRA) b3/   BURNOUT CYCLE IN PROGRESS b3/                                   BURNOUT CYCLE INITIATED b3/
---] [---+---]/[-------------------------------------------------------------------------------------------( )---
129      137 2,228                                                                                            136
BURNOUT CYCLE INITIATED b3/
---] [---
136 2,226
$b003/00136  ... BURNOUT   CYCLE    INITIATED
             2,226     2,226*    2,227     2,229

>>> VERIFY CANISTER DAMPER POSITIONS TO INITIATE                          <<<
>>> OXIDIZER BURNOUT CYCLE.                                               <<<

FILE
  2
RUNG
227
BURNOUT CYCLE INITIATED b3/   CANISTR 2 OUTLET DAMPER OPEN i:00.11   CANISTR 3 OUTLET DAMPER OPEN i:00.17   CANISTR 4 INLET DAMPER OPEN i:10.03   CANISTR 5 INLET DAMPER OPEN i:10.11   CANISTR 1 PURGE DAMPER OPEN i:00.05   BURNOUT CYCLE INITIATE DAMPER POSITION b3/
---] [-------] [-------] [-------] [-------] [-------] [---+-------------------------------------------------( )---
136 2,226                                                                                                      175
```

```
BURNOUT
CYCLE IN
PROGRESS
  b3/
---] [-----------------------------------------------+
  137
 2,228

 $b003/00175  ... BURNOUT   CYCLE     INITIATE  DAMPER    POSITION
              2,227*     2,228
```

>>> OXIDIZER BURNOUT CYCLE IN PROGRESS. <<<

```
FILE
  2
RUNG  BURNOUT
CYCLE INITIATE DAMPER POSITION b3/ | PURGE CYCLE DAMPER CLOSED t:10.16 | BURNOUT CYCLE DAMPER OPEN t:01.04 | BURNERS FIRING b3/ | OXIDIZER READY TO ACCEPT FUME e:03.10 | BURNOUT COOLDOWN COMPLETE t4: | BURNOUT CYCLE IN PROGRESS b3/
 228
---] [-------] [-------] [-------] [-------] [-------]/[-------------------------------------------------------( )---+
  175                                 7       2,33     096.EN                                                    137
 2,227                              2,28                2,238

 $b003/00137  ... BURNOUT   CYCLE IN  PROGRESS
              2,226-     2,227      2,228*     2,229      2,230      2,233      2,234      2,235      2,236
              2,237      2,242      2,243      2,244      2,245      2,246      2,247
```

>>> OXIDIZER BURNOUT CYCLE ON. <<<

```
FILE
  2
RUNG  BURNOUT
CYCLE INITIATED
  b3/                                                                                                  OXIDIZER
 229                                                                                                   BURNOUT
                                                                                                       CYCLE ON
                                                                                                         b3/
---] [---+-------------------------------------------------------------------------------------------( )---+
  136    |                                                                                              161
 2,226   |
         |
         |
         
```

```
>>> BURNOUT CYCLE CANISTER DAMPER SEQUENCING.                                  <<<

FILE
  2

RUNG  OXIDIZER  CYCLE                                                          BURNOUT
 231  BURNOUT   DURATION                                                       CYCLE
      CYCLE ON  TIMER                                                          DURATION
        b3/       t4:                                                          TIMER
                                                                               ENABLE
                                                                                 b3/
     +---] [---+---] [---+-------------------------------------------------------( )---+
       161     | 015.DN |                                                          149
     2,229     |  2,51  |
               |        |
               | BURNOUT |
               | CYCLE   |
               | DURATION |
               | TIMER   |
               | ENABLE  |
               |   b3/   |
               +---] [---+
                   149
                 2,231

  $b003/00149  ... BURNOUT   CYCLE     DURATION  TIMER     ENABLE
                   2,49-     2,50-     2,53-     2,230     2,231     2,231*

>>> CANISTER 1 BURNOUT DAMPER SEQUENCER.                                       <<<

FILE
  2

RUNG  OXIDIZER  CANISTR 1 BURNOUT   CANISTR 1                          +--SQO--------------------+
 232  BURNOUT   BURNOUT   CYCLE     BURNOUT                            |                          |
      CYCLE ON  COMPLETE  ADVANCER  COMPLETE                           | SEQUENCER OUTPUT         |
        b3/       b3/       t4:       b3/                              |                          |
     +---] [-------]/[-------] [-------]/[-------------------------------+ FILE          #$n7:40 +--(EN)--+
       161       164     095.DN      164                              |                          |
     2,229     2,242     2,230     2,242                              | MASK             7FFF +--(DN)--+
                                                                      |                          |
                                                                      | DEST            $n7:7    |
                                                                      |                          |
                                                                      | CONTROL         $r6:1    |
                                                                      | LENGTH              4    |
                                                                      | POSITION            0    |
                                                                      +--------------------------+

  $r006:001    ... CANISTER  1 BURNOUT DAMPER    SEQUENCER
                   2,232*    2,239*
  #$n007:040   ... CANISTER  1 BURNOUT SEQUENCER STARTUP   POSITION
                   2,232*
  $n007:007    ... CANISTER  DAMPER    SEQUENCER OUTPUT
                   2,50*     2,64      2,65      2,66-     2,67      2,68      2,69-     2,70      2,71
                   2,72-     2,73      2,74      2,75-     2,76      2,77      2,78-     2,79      2,80
                   2,81-     2,82      2,83      2,84-     2,85      2,86      2,87-     2,88      2,89
                   2,90-     2,91      2,92      2,93-     2,94      2,95      2,96-     2,97      2,98
                   2,99-     2,100     2,101     2,102-    2,103     2,104     2,105-    2,106      ...

>>> CANISTER 2 BURNOUT DAMPER SEQUENCER.                                       <<<

FILE
  2

RUNG  BURNOUT   CANISTR 1 BURNOUT   CANISTR 2                          +--SQO--------------------+
 233  CYCLE IN  BURNOUT   CYCLE     BURNOUT                            |                          |
      PROGRESS  COMPLETE  ADVANCER  COMPLETE                           | SEQUENCER OUTPUT         |
        b3/       b3/       t4:       b3/                              |                          |
     +---] [-------] [-------] [-------]/[-------------------------------+ FILE          #$n7:45 +--(EN)--+
       137       164     095.DN      165                              |                          |
     2,228     2,242     2,230     2,243                              | MASK             7FFF +--(DN)--+
                                                                      |                          |
                                                                      | DEST            $n7:7    |
                                                                      |                          |
                                                                      | CONTROL         $r6:2    |
                                                                      | LENGTH              3    |
                                                                      | POSITION            0    |
                                                                      +--------------------------+

  $r006:002    ... CANISTER  2 BURNOUT DAMPER    SEQUENCER
                   2,233*    2,239*
  #$n007:045   ... CANISTER  2 BURNOUT SEQUENCER STARTUP   POSITION
                   2,233*
```

```
$n007:007    ... CANISTER  DAMPER    SEQUENCER OUTPUT
             2,50*     2,64      2,65      2,66-     2,67      2,68      2,69-     2,70      2,71
             2,72-     2,73      2,74      2,75-     2,76      2,77      2,78-     2,79      2,80
             2,81-     2,82      2,83      2,84-     2,85      2,86      2,87-     2,88      2,89
             2,90-     2,91      2,92      2,93-     2,94      2,95      2,96-     2,97      2,98
             2,99-     2,100     2,101     2,102-    2,103     2,104     2,105-    2,106      ...
```

>>> CANISTER 3 BURNOUT DAMPER SEQUENCER. <<<

```
FILE
  2

RUNG  BURNOUT   CANISTR 2 BURNOUT   CANISTR 3                          +--SQO----------------------+
234   CYCLE IN  BURNOUT   CYCLE     BURNOUT                            |                            |
      PROGRESS  COMPLETE  ADVANCER  COMPLETE                           | SEQUENCER OUTPUT           |
        b3/       b3/       t4:       b3/                              |                            |
  +---] [-------] [-------] [-------]/[-------------------------------+ FILE            #$n7:65 +--(EN)--+
        137       165     095.DN      166                              |                            |
      2,228     2,243     2,230     2,244                              | MASK              7FFF +--(DN)--+
                                                                       |                            |
                                                                       | DEST             $n7:7     |
                                                                       |                            |
                                                                       | CONTROL          $r6:3     |
                                                                       | LENGTH               3     |
                                                                       | POSITION             0     |
                                                                       |                            |
                                                                       +----------------------------+

$r006:003    ... CANISTER  3 BURNOUT DAMPER    SEQUENCER
             2,234*    2,240*
#$n007:065   ... CANISTER  3 BURNOUT SEQUENCER STARTUP   POSITION
             2,234*
$n007:007    ... CANISTER  DAMPER    SEQUENCER OUTPUT
             2,50*     2,64      2,65      2,66-     2,67      2,68      2,69-     2,70      2,71
             2,72-     2,73      2,74      2,75-     2,76      2,77      2,78-     2,79      2,80
             2,81-     2,82      2,83      2,84-     2,85      2,86      2,87-     2,88      2,89
             2,90-     2,91      2,92      2,93-     2,94      2,95      2,96-     2,97      2,98
             2,99-     2,100     2,101     2,102-    2,103     2,104     2,105-    2,106      ...
```

>>> CANISTER 4 BURNOUT DAMPER SEQUENCER. <<<

```
FILE
  2

RUNG  BURNOUT   CANISTR 3 BURNOUT   CANISTR 4                          +--SQO----------------------+
235   CYCLE IN  BURNOUT   CYCLE     BURNOUT                            |                            |
      PROGRESS  COMPLETE  ADVANCER  COMPLETE                           | SEQUENCER OUTPUT           |
        b3/       b3/       t4:       b3/                              |                            |
  +---] [-------] [-------] [-------]/[-------------------------------+ FILE            #$n7:70 +--(EN)--+
        137       166     095.DN      167                              |                            |
      2,228     2,244     2,230     2,245                              | MASK              7FFF +--(DN)--+
                                                                       |                            |
                                                                       | DEST             $n7:7     |
                                                                       |                            |
                                                                       | CONTROL          $r6:4     |
                                                                       | LENGTH               3     |
                                                                       | POSITION             0     |
                                                                       |                            |
                                                                       +----------------------------+

$r006:004    ... CANISTER  4 BURNOUT DAMPER    SEQUENCER
             2,235*    2,240*
#$n007:070   ... CANISTER  4 BURNOUT SEQUENCER STARTUP   POSITION
             2,235*
$n007:007    ... CANISTER  DAMPER    SEQUENCER OUTPUT
             2,50*     2,64      2,65      2,66-     2,67      2,68      2,69-     2,70      2,71
             2,72-     2,73      2,74      2,75-     2,76      2,77      2,78-     2,79      2,80
             2,81-     2,82      2,83      2,84-     2,85      2,86      2,87-     2,88      2,89
             2,90-     2,91      2,92      2,93-     2,94      2,95      2,96-     2,97      2,98
             2,99-     2,100     2,101     2,102-    2,103     2,104     2,105-    2,106      ...
```

```
>>> CANISTER 5 BURNOUT DAMPER SEQUENCER.                                  <<<

FILE
  2

RUNG  BURNOUT   CANISTR 4 BURNOUT   CANISTR 5                          +--SOO----------------------+
236   CYCLE IN  BURNOUT   CYCLE     BURNOUT                            |                           |
      PROGRESS  COMPLETE  ADVANCER  COMPLETE                           | SEQUENCER OUTPUT          |
        b3/       b3/       t4:       b3/                              |                           |
  +---] [-------] [-------] [-------]/[-----------------------------+  | FILE            #$n7:75   +--(EN)--+
     137       167     095.DN     168                                |  |                           |
    2,228     2,245     2,230     2,246                              |  | MASK              7FFF    +--(DN)--+
                                                                     |  |                           |
                                                                     |  | DEST            $n7:7     |
                                                                     |  |                           |
                                                                     |  | CONTROL         $r6:8     |
                                                                     |  | LENGTH              3     |
                                                                     |  | POSITION            0     |
                                                                     |  |                           |
                                                                     |  +---------------------------+
                                                                     |
$r006:008     ... CANISTER  5 BURNOUT DAMPER    SEQUENCER            |
              2,236*     2,241*                                      |
#$n007:075    ... CANISTER  5 BURNOUT SEQUENCER STARTUP   POSITION   |
              2,236*                                                 |
$n007:007     ... CANISTER  DAMPER    SEQUENCER OUTPUT               |
              2,50*     2,64      2,65      2,66-     2,67      2,68      2,69-     2,70      2,71
              2,72-     2,73      2,74      2,75-     2,76      2,77      2,78-     2,79      2,80
              2,81-     2,82      2,83      2,84-     2,85      2,86      2,87-     2,88      2,89
              2,90-     2,91      2,92      2,93-     2,94      2,95      2,96-     2,97      2,98
              2,99-     2,100     2,101     2,102-    2,103     2,104     2,105-    2,106      ...

>>> BURNOUT COOLDOWN DAMPER SEQUENCER.                                   <<<

FILE
  2

RUNG  BURNOUT   CANISTR 5 BURNOUT                                  BURNOUT   +--SOO----------------------+
237   CYCLE IN  BURNOUT   CYCLE                                    COOLDOWN  |                           |
      PROGRESS  COMPLETE  ADVANCER                                 COMPLETE  | SEQUENCER OUTPUT          |
        b3/       b3/       t4:                                      t4:     |                           |
  +---] [-------] [-------] [-----------------------------------+---]/[-----+ FILE            #$n7:80   +--(EN)--+
     137       168     095.DN                                    |  096.DN  |                           |
    2,228     2,246     2,230                                    |  2,238   | MASK              7FFF    +--(DN)--+
                                                                 |          |                           |
                                                                 |          | DEST            $n7:7     |
                                                                 |          |                           |
                                                                 |          | CONTROL         $r6:9     |
                                                                 |          | LENGTH              4     |
                                                                 |          | POSITION            0     |
                                                                 |          |                           |
                                                                 |          +---------------------------+
                                                                 |
                                                                 |          +--TON-------------------------+
                                                                 |          |                           |
                                                                 |          | TIMER ON DELAY            |
                                                                 +----------+ TIMER           $t4:94    +--(EN)--+
                                                                            |                           |
                                                                            | TIME BASE (SEC)     1.0   +--(DN)--+
                                                                            |                           |
                                                                            | PRESET              300   |
                                                                            |                           |
                                                                            | ACCUM                 0   |
                                                                            |                           |
                                                                            +---------------------------+

$r006:009     ... CANISTER  COOLDOWN  DAMPER    SEQUENCER
              2,237*     2,241*
#$n007:080    ... BURNOUT   COOLDOWN  SEQUENCER STARTUP   POSITION
              2,237*
$n007:007     ... CANISTER  DAMPER    SEQUENCER OUTPUT
              2,50*     2,64      2,65      2,66-     2,67      2,68      2,69-     2,70      2,71
              2,72-     2,73      2,74      2,75-     2,76      2,77      2,78-     2,79      2,80
              2,81-     2,82      2,83      2,84-     2,85      2,86      2,87-     2,88      2,89
              2,90-     2,91      2,92      2,93-     2,94      2,95      2,96-     2,97      2,98
              2,99-     2,100     2,101     2,102-    2,103     2,104     2,105-    2,106      ...
$t004:094     ... OXIDIZER  BURNOUT   COOLDOWN  TIMER
              2,237*     2,238
```

```
>>> BURNOUT CYCLE 5 MINUTE COOLDOWN.                                    <<<

FILE
  2
RUNG  OXIDIZER
 238  BURNOUT
      COOLDOWN
      TIMER
        t4:                                                  +--TON----------------------+
      +---] [-------------+-------------------------------------+ TIMER ON DELAY          |
      | 094.DN            |                                     | TIMER            $t4:96 +---(EN)---+
      |  2,237            |                                     | TIME BASE (SEC)     0.01 +---(DN)---+
      |                   |                                     | PRESET               300 |
      |                   |                                     | ACCUM                  0 |
      |                   |                                     +--------------------------+
      | BURNOUT   BURNOUT |
      | COOLDOWN  COOLDOWN |
      | COMPLETE  COMPLETE |
      |   t4:       t4:   |
      +---] [-------]/[---+
      | 096.EN    096.DN
      |  2,238     2,238
      |
      | $t004:096    ... BURNOUT   COOLDOWN  COMPLETE
      |                  2,228-     2,237-     2,238      2,238-     2,238*

>>> BURNOUT CYCLE DAMPER SEQUENCER RESET.                               <<<

FILE
  2
RUNG  OXIDIZER                                               +--MOV----------------------+
 239  BURNOUT                                               | MOVE                     |
      CYCLE ON                                              |                          |
        b3/                                                 | SOURCE                 0 +---------+
      +---]/[-------------------------------------------------+                          |
        161                                                 |                          |
       2,229                                                | DEST            $r6:1POS |
                                                            |                        0 |
                                                            +--------------------------+

                                                            +--MOV----------------------+
                                                            | MOVE                     |
                                                            |                          |
                                                            | SOURCE                 0 +---------+
                                                            |                          |
                                                            | DEST            $r6:2POS |
                                                            |                        0 |
                                                            +--------------------------+

      $r006:001    ... CANISTER  1 BURNOUT DAMPER    SEQUENCER
                       2,232*     2,239*
      $r006:002    ... CANISTER  2 BURNOUT DAMPER    SEQUENCER
                       2,233*     2,239*

>>> BURNOUT CYCLE DAMPER SEQUENCER RESET.                               <<<

FILE
  2
RUNG  OXIDIZER                                               +--MOV----------------------+
 240  BURNOUT                                               | MOVE                     |
      CYCLE ON                                              |                          |
        b3/                                                 | SOURCE                 0 +---------+
      +---]/[-------------------------------------------------+                          |
        161                                                 |                          |
       2,229                                                | DEST            $r6:3POS |
                                                            |                        0 |
                                                            +--------------------------+
```

```
                                                                  +--MOV----------------------+
                                                                  | MOVE                      |
                                                                  | SOURCE                0   |
                                                                  | DEST            $r6:4POS  |
                                                                  |                         0 |
                                                                  +---------------------------+

$r006:003   ... CANISTER  3 BURNOUT DAMPER    SEQUENCER
            2,234*     2,240*
$r006:004   ... CANISTER  4 BURNOUT DAMPER    SEQUENCER
            2,235*     2,240*

        >>> BURNOUT CYCLE DAMPER SEQUENCER RESET.                    <<<
FILE
  2
RUNG  OXIDIZER
241   BURNOUT                                                     +--MOV----------------------+
      CYCLE ON                                                    | MOVE                      |
        b3/                                                       | SOURCE                0   |
    ---]/[-------------------------------------------------------+ DEST            $r6:8POS  |
      161                                                         |                         0 |
     2,229                                                        +---------------------------+

                                                                  +--MOV----------------------+
                                                                  | MOVE                      |
                                                                  | SOURCE                0   |
                                                                  | DEST            $r6:9POS  |
                                                                  |                         0 |
                                                                  +---------------------------+

$r006:008   ... CANISTER  5 BURNOUT DAMPER    SEQUENCER
            2,236*     2,241*
$r006:009   ... CANISTER  COOLDOWN  DAMPER    SEQUENCER
            2,237*     2,241*

        >>> CANISTER 1 BURNOUT COMPLETE.                             <<<
FILE
  2
                CANISTR 1
RUNG  BURNOUT   PURGE                                                                 CANISTR 1
242   CYCLE IN  DAMPER                                                                BURNOUT
      PROGRESS  OPEN                                                                  IN PROG
        b3/     1:00.05                                                                 b3/
    ---] [---+---] [---+-------------------------------------------------------------+-------------( )---+
      137    |         |                                                             |                 156 |
     2,228   |         |                                                             |                     |
             |         |                                                             |                     |
             |         |                                                             +--GRT----------------+ CANISTR 1
             |         |                                                             | GREATER THAN        | BURNOUT
             |         |                                                             |                     | COMPLETE
             |         |                                                             | SOURCE A      $n9:40 | b3/
             |         |                                                             |                  51 |-------( )---+
             |         |                                                             | SOURCE B         800 | 164
             |         |                                                             |                     |
             |         |                                                             +---------------------+
             |         |
             |         |
             |         |
```

```
>>> CANISTER 2 BURNOUT COMPLETE.                                   <<<

FILE
  2

RUNG  BURNOUT    CANISTR 2                                                  CANISTR 2
 243  CYCLE IN   PURGE                                                      BURNOUT
      PROGRESS   DAMPER                                                     IN PROG
        b3/      OPEN                                                         b3/
        137     1:00.13
      2,228                                                                  157

                                                   +--GRT----------------+   CANISTR 2
                                                   |                     |   BURNOUT
                                                   | GREATER THAN        |   COMPLETE
                                                   |                     |     b3/
                                                   | SOURCE A      $n9:73 |
                                                   |                  50 |
                                                   | SOURCE B        800 |
                                                   +---------------------+

                CANISTR 2
                BURNOUT
                COMPLETE
                  b3/
                165
               2,243

$b003/00157  ... CANISTR 2 BURNOUT   IN PROG
                 2,243*
$n009:073    ... CANISTR 2 OUTLET    TEMP
                 2,193*    2,199*    2,205*    2,243*    2,248*
$b003/00165  ... CANISTR 2 BURNOUT   COMPLETE
                 2,233-    2,234     2,243     2,243*    2,247

>>> CANISTER 3 BURNOUT COMPLETE.                                   <<<

FILE
  2

RUNG  BURNOUT    CANISTR 3                                                  CANISTR 3
 244  CYCLE IN   PURGE                                                      BURNOUT
      PROGRESS   DAMPER                                                     IN PROG
        b3/      OPEN                                                         b3/
        137     1:10.01
      2,228                                                                  158

                                                   +--GRT----------------+   CANISTR 3
                                                   |                     |   BURNOUT
                                                   | GREATER THAN        |   COMPLETE
                                                   |                     |     b3/
                                                   | SOURCE A      $n9:74 |
                                                   |                  49 |
                                                   | SOURCE B        800 |
                                                   +---------------------+

                CANISTR 3
                BURNOUT
                COMPLETE
                  b3/
                166
               2,244

$b003/00158  ... CANISTR 3 BURNOUT   IN PROG
                 2,244*
$n009:074    ... CANISTR 3 OUTLET    TEMP
                 2,194*    2,200*    2,206*    2,244*
$b003/00166  ... CANISTR 3 BURNOUT   COMPLETE
                 2,234-    2,235     2,244     2,244*    2,247

>>> CANISTER 4 BURNOUT COMPLETE.                                   <<<

FILE
  2

RUNG  BURNOUT    CANISTR 4                                                  CANISTR 4
 245  CYCLE IN   PURGE                                                      BURNOUT
      PROGRESS   DAMPER                                                     IN PROG
        b3/      OPEN                                                         b3/
        137     1:10.07
      2,228                                                                  159

                                                   +--GRT----------------+   CANISTR 4
                                                   |                     |   BURNOUT
                                                   | GREATER THAN        |   COMPLETE
                                                   |                     |     b3/

                CANISTR 4
                BURNOUT
                COMPLETE
                  b3/
```

```
        +---] [---+                                                  +---+ SOURCE A      $n9:75 +-------( )---+
          167                                                                 50                 167
         2,245                                                         |
                                                                       | SOURCE B        800
                                                                       |
                                                                       +----------------------+

$b003/00159  ... CANISTR 4 BURNOUT   IN PROG
             2,245*
$n009:075    ... CANISTR 4 OUTLET    TEMP
             2,195*     2,201*     2,207*     2,245*
$b003/00167  ... CANISTR 4 BURNOUT   COMPLETE
             2,235-     2,236      2,245      2,245*     2,247

        >>> CANISTER 4 BURNOUT COMPLETE.                                  <<<

FILE
  2

              CANISTR 5
RUNG  BURNOUT  PURGE                                                                          CANISTR 5
 246  CYCLE IN DAMPER                                                                        BURNOUT
      PROGRESS OPEN                                                                          IN PROG
        b3/    1:10.15                                                                        b3/
     +---] [---+---] [---+-------------------------------------------------------------+-------------------( )---+
       137     |         |                                                             |                     160
      2,228    |         |                                                             |
               |         |                                                             |
               |         |                                                             |
               
```

means for selectively directing the effluent to be processed through at least one inlet regenerator to the combustion chamber and directing the processed effluent from the combustion chamber through at least one outlet regenerator to be exhausted to the atmosphere;

means for inducing flow from an idle regenerator to purge the idle regenerator of any residual effluent therein, the induced flow through the idle regenerator directed away from the combustion chamber, the inducing means selectively directing a continuing induced flow through the idle regenerator for a period sufficient to heat the entire refractory heat exchange materials of the idle regenerator to a temperature sufficient to volatize hydrocarbons trapped therein, and directing flow from the idle regenerator to an inlet to the combustion chamber;

wherein said means for selectively directing alternates said one inlet regenerator and said one outlet regenerator until said idle regenerator reaches said sufficient temperature; and, means for periodically altering the direction of flow of the effluent through the apparatus such that the former inlet regenerator becomes an idle regenerator and the former outlet regenerator becomes an inlet regenerator and the former idle regenerator becomes an outlet regenerator.

2. A regenerative thermal incineration apparatus as defined in claim 1 wherein the flow inducing means comprises:

a fan inducing gas flow from the idle regenerator;

first means for selectably directing the flow to the at least one inlet regenerator; and, second means for selectably directing the flow to the combustion chamber inlet.

3. A regenerative thermal incineration apparatus comprising:

at least heat exchange regenerators, each regenerator containing a quantity of refractory heat exchange material;

means for supplying an effluent to be processed to a selected one of the regenerators as an inlet regenerator;

a combustion chamber common to and communicating with each of the regenerators, having an air fuel system with at least one burner;

means for directing the effluent to be processed through the selected one of the regenerators to the combustion chamber;

means for extracting effluent processed in the combustion chamber through a second regenerator as an outlet regenerator for expulsion from the apparatus;

means for drawing a flow of gas from the combustion chamber through a third idle regenerator;

means for selectably direction the gas flow from said idle regenerator to the supplying means;

means for selectably directing the gas flow from said idle regenerator to an inlet to the combustion chamber; and means for periodically altering the direction of flow of effluent in a first sequence continuing flow of gas through the idle regenerator for a period sufficient to heat the entire quantity of refractory material in the idle regenerator to a temperature sufficiently high to volatize hydrocarbon trapped therein, while alternating flow direction through said inlet and outlet regenerators, and in a second sequence, such that the former inlet regenerator becomes the idle regenerator, the outlet regenerator becomes the inlet regenerator, and the idle regenerator becomes the outlet regenerator.

4. A regenerative thermal incineration apparatus as defined in claim 3, wherein each regenerator incorporates a plenum distal the communication with the combustion chamber and the drawing means comprises:

a fan having an inlet in communication with the plenum to draw gas in a direction from the combustion chamber through the refractory material contained in the regenerator into the plenum and through the fan, an outlet of the fan connected to a first conduit having a valve for selectably directing flow from the outlet of the fan to the supplying means and a second conduit, connected to the outlet of the fan, having a second valve for selectably allowing flow from the outlet of the fan to the inlet to the combustion chamber.

5. A method for purging and burnout of contaminant contaminants present in a regenerative thermal incinerator apparatus having a plurality of regenerators comprising the steps of:

directing a flow of gas to be processed through an inlet regenerator to the combustion chamber;

directing flow from an outlet regenerator receiving gas from the combustion chamber and exhausting the gas;

drawing gas from an idle regenerator to purge residual gas in the regenerator;

directing the purged gas to the inlet regenerator for processing;

periodically altering the flow of gas in the regenerator to make the former inlet regenerator, the idle regenerator, and the former idle regenerator, the outlet regenerator and the former outlet regenerator the inlet regenerator;

periodically directing the gas flow from the idle regenerator directly to the combustion chamber and alternately cycling the inlet and outlet regenerators while maintaining flow through the idle regenerator to increase the temperature of the idle regenerator for volatilization of trapped contaminant compounds;

altering the flow direction in the regenerators such that the former idle regenerator becomes the inlet regenerator, the outlet regenerator, becomes the idle regenerator, and the inlet regenerator becomes the outlet regenerator.

6. A method as defined in claim 5 wherein the regenerative thermal incineration apparatus incorporates five regenerators and the periodic alteration of the direction of flow of gas is accomplished according to the following cycles:

| REGENERATOR | 1 | 2 | 3 | 4 | 5 | |
|---|---|---|---|---|---|---|
| | I | I | O | O | P | Normal |
| | P | I | I | O | O | Cycling |
| Regenerator #5 | O | I | O | I | B | Burnout |
| | O | O | I | I | B | Mode |
| | I | O | O | I | B | |
| | O | I | O | I | B | |
| | O | O | I | I | B | |
| | . | . | . | . | . | |
| | . | . | . | . | . | |
| | . | . | . | . | . | |
| | O | O | I | I | B | |
| Regenerator #1 | B | O | I | O | I | |
| | B | O | O | I | I | |

-continued

| REGENERATOR | 1 | 2 | 3 | 4 | 5 | |
|---|---|---|---|---|---|---|
| | B | I | O | O | I | |
| | B | O | I | O | I | |
| | B | O | O | I | I | |
| | . | . | . | . | . | |
| | . | . | . | . | . | |
| | . | . | . | . | . | |
| | B | O | O | I | I | |
| Regenerator #2 | I | B | O | I | O | |
| | I | B | O | O | I | |
| | I | B | I | O | O | |
| | I | B | O | I | O | |
| | I | B | O | O | I | |
| | . | . | . | . | . | |
| | . | . | . | . | . | |
| | . | . | . | . | . | |
| | I | B | O | O | I | |
| Regenerator #3 | O | I | B | O | I | |
| | I | I | B | O | O | |
| | O | I | B | I | O | |
| | O | I | B | O | I | |
| | I | I | B | O | O | |
| | . | . | . | . | . | |
| | . | . | . | . | . | |
| | . | . | . | . | . | |
| | I | I | B | O | O | |
| Regenerator #4 | I | O | I | B | O | |
| | O | I | I | B | O | |
| | O | O | I | B | I | |
| | I | O | I | B | O | |
| | O | I | I | B | O | |
| | . | . | . | . | . | |
| | . | . | . | . | . | |
| | . | . | . | . | . | |
| | O | I | I | B | O | |
| | O | P | I | I | O | Normal |
| | O | O | P | I | I | Cycling |
| | I | O | O | P | I | |

I = INLET
O = OUTLET
B = BURNOUT
P = PURGE

7. A method as defined in claim 5 wherein the regenerative thermal incineration apparatus incorporates five regenerators and the periodic alteration of the direction of flow of gas is accomplished according to the following cycles:

| REGENERATOR | 1 | 2 | 3 | 4 | 5 | |
|---|---|---|---|---|---|---|
| Normal | P | O | O | I | I | Normal |
| Cycling | O | O | I | I | P | Incineration Mode |
| Start #1 | B | I | O | C | I | This is |

-continued

| REGENERATOR | 1 | 2 | 3 | 4 | 5 | |
|---|---|---|---|---|---|---|
| Regenerator | B | O | I | C | I | repeated |
| Inlet | | | | | | until the |
| Flow | B | I | O | C | I | area below the |
| (Maximum of | B | O | I | C | I | bed reaches |
| 50% capacity) | B | I | O | C | I | burnout temp. |
| | . | . | . | . | . | |
| | . | . | . | . | . | |
| | . | . | . | . | . | |
| | B | O | I | C | I | |
| Start #2 | I | B | O | I | C | |
| Regenerator | I | B | I | O | C | |
| | I | B | O | I | C | |
| | I | B | I | O | C | |
| | . | . | . | . | . | |
| | . | . | . | . | . | |
| | . | . | . | . | . | |
| Regenerator #2 | I | B | O | I | C | |
| at burnout | | | | | | |
| temp. | | | | | | |
| Start #3 | C | I | B | O | I | |
| Regenerator | C | I | B | I | O | |
| Burnout | C | I | B | O | I | |
| | C | I | B | I | O | |
| | . | . | . | . | . | |
| | . | . | . | . | . | |
| | . | . | . | . | . | |
| Regenerator #3 | C | I | B | O | I | |
| at burnout | | | | | | |
| temp. | | | | | | |
| Start #4 | I | C | I | B | O | |
| Regenerator | O | C | I | B | I | |
| Burnout | I | C | I | B | O | |
| | O | C | I | B | I | |
| | . | . | . | . | . | |
| | . | . | . | . | . | |
| | . | . | . | . | . | |
| Regenerator #4 | I | C | I | B | O | |
| at burnout | | | | | | |
| temp. | | | | | | |
| Start #5 | O | I | C | I | B | |
| Regenerator | I | O | C | I | B | |
| Burnout | O | I | C | I | B | |
| | I | O | C | I | B | |
| | . | . | . | . | . | |
| | . | . | . | . | . | |
| | . | . | . | . | . | |
| Regenerator #5 | O | C | C | O | B | |
| at burnout | | | | | | |
| temp. | | | | | | |
| Normal | P | O | O | I | I | Return to |
| Cycling | O | O | I | I | P | Normal |
| | | | | | | Incineration |
| | | | | | | Mode. |

I = INLET
O = OUTLET
P = PURGE
B = BURNOUT
C = CLOSED/IDLE

* * * * *

UNITED STATES PATENT AND TRADEMARK OFFICE

CERTIFICATE OF CORRECTION

PATENT NO. : 5,259,757

DATED : November 9, 1993

INVENTOR(S) : Marlin D. Plejdrup; Melanius D'Souza

It is certified that error appears in the above-indentified patent and that said Letters Patent is hereby corrected as shown below:

In the Specification:

Column 2, line 6, change "volitize" to -- volatilize --.

Column 4, line 65, change "FIG." to -- FIGS. --.

Column 4, line 67, after "operate" insert -- in the --.

Column 6, line 34, change "Regenerator 1" to -- regenerator 1 --.

Column 6, lines 43,44, change "Regenerators 4" to -- Regenerator 4 --.

Column 7, line 27, after "Regenerator #5" change "O C C I B" to -- O C C O B --.

Column 7, line 54, change "volitized" to -- volatilized --.

Column 8, line 40, after "regenerator 5" insert -- and --.

UNITED STATES PATENT AND TRADEMARK OFFICE

CERTIFICATE OF CORRECTION

PATENT NO. : 5,259,757

DATED : November 9, 1993

INVENTOR(S) : Marlin D. Plejdrup; Melanius D'Souza

It is certified that error appears in the above-indentified patent and that said Letters Patent is hereby corrected as shown below:

In the Claims:

Column 83, line 15, change "volatize" to -- volatilize --.

Column 83, line 38, after "at least" insert -- three --.

Column 83, line 56, change "direction" to -- directing --.

Column 83, line 66, change "volatize" to -- volatilize --.

Column 83, line 66, change "hydrocarbon" to -- hydrocarbons --.

Column 84, line 20, delete "contaminant".

Signed and Sealed this

Fourteenth Day of June, 1994

Bruce Lehman

*Attest:*

BRUCE LEHMAN

*Attesting Officer*

*Commissioner of Patents and Trademarks*